US011627853B2

(12) United States Patent
Park et al.

(10) Patent No.: US 11,627,853 B2
(45) Date of Patent: Apr. 18, 2023

(54) ROBOTIC CLEANER AND CONTROL METHOD THEREFOR

(71) Applicant: SAMSUNG ELECTRONICS CO., LTD., Suwon-si (KR)

(72) Inventors: Minji Park, Suwon-si (KR); Jeehyeok Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 296 days.

(21) Appl. No.: 16/959,242

(22) PCT Filed: Jan. 16, 2019

(86) PCT No.: PCT/KR2019/000656
§ 371 (c)(1),
(2) Date: Jun. 30, 2020

(87) PCT Pub. No.: WO2019/143129
PCT Pub. Date: Jul. 25, 2019

(65) Prior Publication Data

US 2020/0329935 A1 Oct. 22, 2020

(30) Foreign Application Priority Data

Jan. 19, 2018 (KR) ..... 10-2018-0007354

(51) Int. Cl.
*A47L 9/28* (2006.01)

(52) U.S. Cl.
CPC ..... *A47L 9/2852* (2013.01); *A47L 9/2805* (2013.01); *A47L 9/2857* (2013.01); *A47L 9/2873* (2013.01);
(Continued)

(58) Field of Classification Search
None
See application file for complete search history.

(56) References Cited

U.S. PATENT DOCUMENTS 11,199,853 B1 * 12/2021 Afrouzi ..... G05D 1/0246
11,435,192 B1 * 9/2022 Ebrahimi Afrouzi ..... G05D 1/0272
(Continued)

FOREIGN PATENT DOCUMENTS

DE 102017104428 A1 * 9/2018 ..... G05D 1/0274
JP 2002-318620 10/2002
(Continued)

OTHER PUBLICATIONS

International Search Report for PCT/KR2019/000656 dated Apr. 12, 2019, 4 pages.
(Continued)

*Primary Examiner* — Joseph H Feild
*Assistant Examiner* — Rufus C Point
(74) *Attorney, Agent, or Firm* — Nixon & Vanderhye, P.C.

(57) ABSTRACT

According to various embodiments, a robotic cleaner may include a battery; a driving device for moving the robotic cleaner; a cleaning device for allowing the robotic cleaner to perform cleaning work; and a processor configured to determine, as a zone that can be cleaned, a first zone in the entire space by considering the residual capacity of the battery and the location of a charging device, operate the driving device and cleaning device to perform cleaning of the first zone, and perform control such that the robotic cleaner moves to the location of the charging device. Other embodiments are possible.

11 Claims, 17 Drawing Sheets

(52) U.S. Cl.
CPC ..... *A47L 9/2894* (2013.01); *A47L 2201/022* (2013.01); *A47L 2201/04* (2013.01)

(56) References Cited

U.S. PATENT DOCUMENTS

| | | | | |
|---|---|---|---|---|
| 2004/0088081 | A1 | 5/2004 | Song et al. | |
| 2010/0082193 | A1* | 4/2010 | Chiappetta | G05D 1/0016 455/127.1 |
| 2011/0241616 | A1* | 10/2011 | Kim | H02J 50/20 320/108 |
| 2015/0148949 | A1* | 5/2015 | Chin | G05D 1/0246 700/245 |
| 2017/0265703 | A1* | 9/2017 | Park | B25J 9/16 |
| 2017/0332857 | A1* | 11/2017 | Nam | A47L 5/22 |
| 2017/0361468 | A1* | 12/2017 | Cheuvront | A47L 9/2857 |
| 2018/0194006 | A1* | 7/2018 | Gu | A47L 9/2826 |
| 2018/0317725 | A1 | 11/2018 | Lee et al. | |
| 2018/0344116 | A1* | 12/2018 | Schriesheim | G06F 3/0486 |
| 2019/0339715 | A1* | 11/2019 | Kwak | G06K 7/10306 |
| 2021/0085146 | A1* | 3/2021 | Cho | G05D 1/0044 |

FOREIGN PATENT DOCUMENTS

| | | | | |
|---|---|---|---|---|
| KR | 10-2011-0111956 | | 10/2011 | |
| KR | 10-1459245 | | 11/2014 | |
| KR | 10-2016-0021991 | | 2/2016 | |
| KR | 20160021991 | A * | 2/2016 | A47L 9/2857 |
| KR | 10-1647757 | | 8/2016 | |
| KR | 10-2017-0048815 | | 5/2017 | |
| KR | 20140017216 | A * | 5/2017 | A47L 11/28 |
| KR | 20170048815 | A * | 5/2017 | A47L 9/28 |
| KR | 20190090757 | A * | 11/2019 | A47L 11/4061 |

OTHER PUBLICATIONS

Written Opinion of the ISA for PCT/KR2019/000656 dated Apr. 12, 2019, 6 pages.

* cited by examiner

ROBOTIC CLEANER AND CONTROL METHOD THEREFOR

This application is a National Phase Entry of PCT International Application No. PCT/KR2019/000656, which was filed on Jan. 16, 2019 and claims priority to Korean Patent Application No. 10-2018-0007354, which was filed on Jan. 19, 2018, the contents of which are incorporated herein by reference.

BACKGROUND

Various embodiments of the disclosure relate to a robotic cleaner and a method of controlling the same.

DESCRIPTION OF RELATED ART

In general, a robotic cleaner is a device that automatically cleans a zone to be cleaned by suctioning foreign substances such as dust from a floor surface while moving by itself without user intervention. The robotic cleaner is capable of detecting obstacles or the like located in the cleaning zone using various sensors, and use the detection result to set a moving path and execute a cleaning operation.

SUMMARY

Conventional robotic cleaners have problems such as battery drainage during cleaning in a specific space depending on the area of the space to be cleaned, the duration of the battery, or the like with reference to a charging device (also called a "charging station"). For example, in the case of the conventional robotic cleaners, when the residual capacity of the battery becomes a predetermined reference value or less during cleaning, the robotic cleaner is caused to move to the charging device for charging the battery. However, conventionally, depending on the distance between the robotic cleaner and the charging device, during the movement of the robotic cleaner toward the charging device, a battery is often discharged, and thus the operation of the robotic cleaner is often stopped. In order to prevent the discharge problem of the battery as described above, when a user uses a robotic cleaner in order to clean a large space, a plurality of charging devices may be installed in various places.

Conventionally, when a plurality of robotic cleaners cleans a specific space, cleaning zones of the robotic cleaners may overlap. In order to solve this problem, conventionally, a specialist who knows the overall size and layout of the space to be cleaned may determine the arrangement of the robotic cleaners.

According to various embodiments, it is possible to provide a robotic cleaner and a control method thereof that are capable of solving the problem that causes a robotic cleaner to stop before reaching a charging device due to the discharge of a battery.

According to various embodiments, it is possible to provide a robotic cleaner and a control method thereof that are capable of solving the problem that causes cleaning zones of robotic cleaners to overlap when a plurality of robotic cleaners clean one space.

According to various embodiments, it is possible to provide a robotic cleaner and a control method thereof that are capable of providing information about an available cleaning zone and/or an available cleaning time to a user.

According to various embodiments, a robotic cleaner may include: a battery; a driving device configured to move the location of the robotic cleaner; a cleaning device configured to allow the robotic cleaner to perform cleaning work; and a processor configured to: determine a first zone in an entire space as an available cleaning zone in consideration of a residual capacity of the battery and a location of a charging device; and control a positional movement to the charging device while executing the cleaning work for the first zone by driving the driving device and the cleaning device.

According to various embodiments, a method of controlling a robotic cleaner may include: an operation of determining a first zone in an entire space as an available cleaning zone in consideration of a residual capacity of a battery of the robotic cleaner and a location of a charging device; and an operation of performing a positional movement to the charging device while executing a cleaning work for the first zone.

According to various embodiments, in a machine-readable storage medium, which stores a program for executing a method of controlling a robotic cleaner, the method may include: an operation of determining a first zone in an entire space as an available cleaning zone in consideration of a residual capacity of a battery of the robotic cleaner and a location of a charging device; and an operation of performing a positional movement to the charging device while executing cleaning work for the first zone.

With a robotic cleaner according to various embodiments and a method of controlling the same, it is possible to solve the problem that causes the robotic cleaner to stop before reaching a charging device due to battery drainage.

With a robotic cleaner according to various embodiments and a method of controlling the same, it is possible to solve the problem that causes, when a plurality of robotic cleaners cleans one space, the cleaning zones of the robotic cleaners to overlap.

A robotic cleaner according to various embodiments and a method of controlling the same are capable of providing a user with information about an available cleaning zone and/or an available cleaning time. For example, the robotic cleaner is capable of providing the user with information corresponding to an available continuous-cleaning time and/or an available cleaning zone based on a residual capacity of the battery, space information, or the like at the start of cleaning or during cleaning.

DETAILED DESCRIPTION

Figure 1:
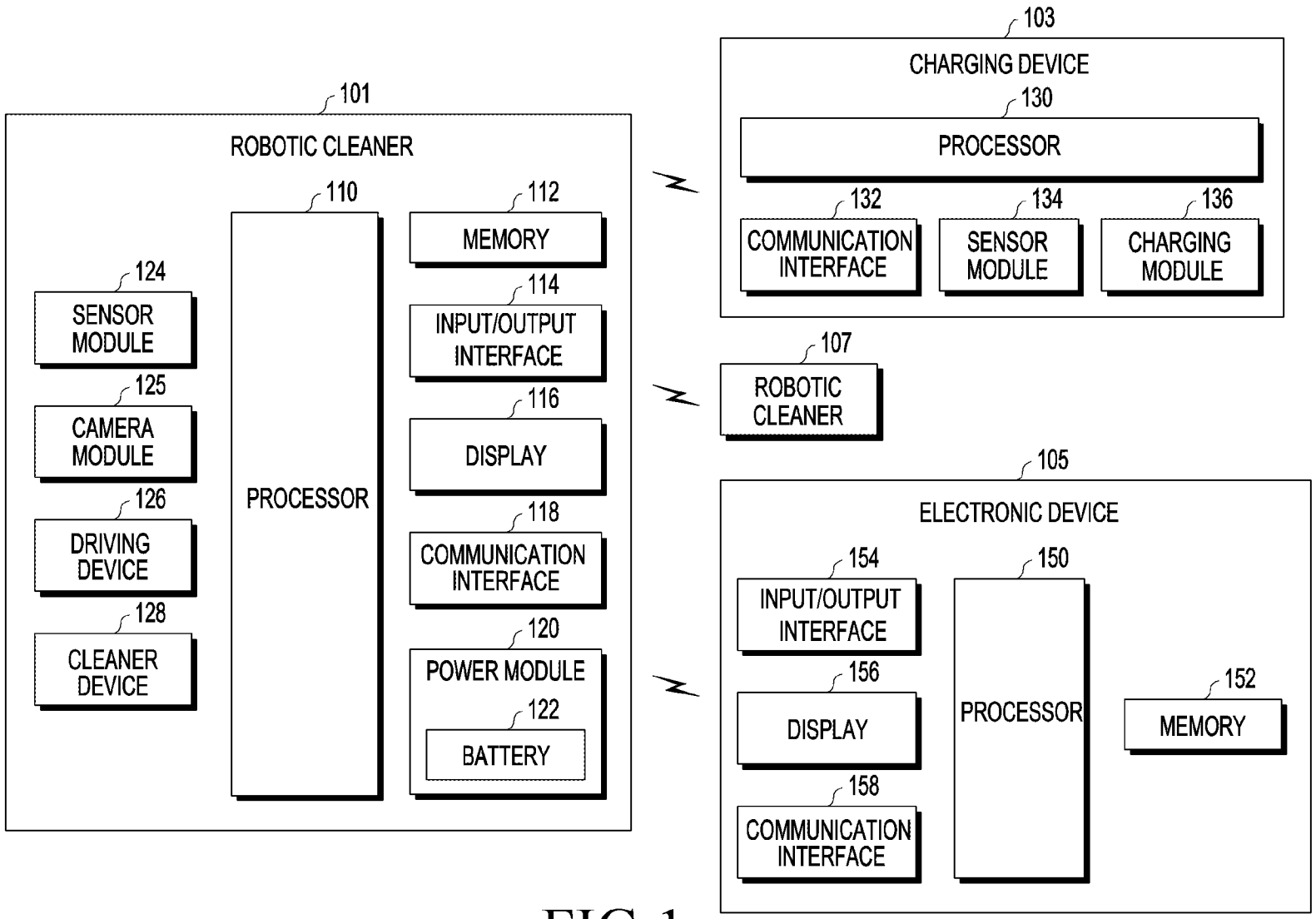
FIG. 1 is a block diagram of a control system of a robotic cleaner according to various embodiments.

FIG. 1 is a block diagram of a control system of a robotic cleaner 101 according to various embodiments.

According to an embodiment, the robotic cleaner 101 may include a processor 110, a memory 112, an input/output interface 114, a display 116, a communication interface 118, a power module 120, a sensor module 124, a camera module 125, a driving device 126, and a cleaning device 128. In some embodiments, at least one of the components may be omitted from the robotic cleaner 101, or other components may be additionally included in the robotic cleaner 101.

The processor 110 may execute, for example, an arithmetic operation or data processing that is related to control and/or communication of one or more other components of the robotic cleaner 101.

The memory 112 may include a volatile memory and/or a nonvolatile memory. The memory 112 may store, for example, commands or data related to the one or more other components of the robotic cleaner 101. According to an embodiment, the memory 112 may store software and/or a program (not illustrated).

The input/output interface 114 may transmit commands or data, which are input by, for example, a user or another external device, to the other component(s) of the robotic cleaner 101, or may output commands or data, which are received from the other component(s) of the robotic cleaner 101, to the user or the another external device.

The display device 116 may include, for example, a liquid crystal display (LCD), a light-emitting diode (LED) display, an organic light-Emitting diode (OLED) display, a microelectromechanical system (MEMS) display, or an electronic paper display. The display 116 may display various contents (e.g., text, image, video, icon, and/or symbol) to, for example, the user. The display 116 may include a touch screen, and may receive touch input, gesture input, proximity input, or hovering input that is made using, for example, an electronic pen or a part of the user's body.

The communication interface 118 may set, for example, communication between the robotic cleaner 101 and an external device (e.g., a charging device 103, an electronic device 105, or a robotic cleaner 107). For example, the communication interface 118 may be connected with a network (not illustrated) through wired or wireless communication so as to communicate with an external device (e.g., a charging device 103, an electronic device 105, or a robotic cleaner 107).

The wireless communication may include a cellular communication that uses at least one of, for example, long-term evolution (LTE), LTE Advance (LTE-A), code division multiple access (CDMA), wideband CDMA (WCDMA), universal mobile telecommunication system (UMTS), wireless broadband (WiBro), and global system for mobile communication (GSM). According to an embodiment, the wireless communication may include at least one of, for example, Wi-Fi, Bluetooth, Bluetooth low energy (BLE), Zigbee, nearfield communication (NFC), magnetic secure transmission, radio frequency (RF), and body area network (BAN). According to an embodiment, the wireless communication may include GNSS. The GNSS may be, for example, at least one of global positioning system (GPS), global navigation satellite system (Glonass), Beidou navigation satellite system (hereinafter, "Beidou"), Galileo, or the European global satellite-based navigation system. Herein, "GPS" may be interchangeably used with "GNSS" below.

The wired communication may use at least one of, for example, universal serial bus (USB), high-definition multimedia interface (HDMI), recommended standard 232 (RS-232), and plain old telephone service (POTS). The network connected to the communication interface 118 may include at least one of telecommunication networks such as a computer network (e.g., LAN or WAN), the Internet, or a telephone network.

The power module 120 may supply driving power for driving the robotic cleaner 101. The power module 120 may be electrically connected to a main body (not illustrated) of the robotic cleaner 101 and respective driving devices for driving various components mounted in the main body. The power module 120 may include a battery 122. The battery 122 may be a rechargeable secondary battery, and may be charged by receiving power from the charging device 103 (also referred to as a "charging station").

The sensor module 124 may generate an electrical signal or a data value corresponding to an internal operating state (e.g., power or temperature) of the robotic cleaner 101 or an external environmental state. The sensor module 124 may include at least one of, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, an ultrasonic sensor, or an illuminance sensor.

In an embodiment, the processor 110 may analyze an electrical signal or data value acquired through the sensor module 124 to identify at least one of the presence/absence of an obstacle, the distance between the body of the robotic cleaner 101 and the floor surface, or the slope of the robotic cleaner 101, and may form a map for a moving or cleaning region of the robotic cleaner 101.

The camera module 125 may capture a still image and a moving image. According to an embodiment, the camera module 125 may include one or more lenses, an image sensor, an image signal processor, or a flash. The camera module 125 may also include a 3D camera, which may be implemented as a stereoscopic camera or the like. For example, the processor 110 may recognize the location of the robotic cleaner 101 by analyzing an image acquired through the camera module 125, and may form a map for a moving or cleaning region of the robotic cleaner 101. For example, the processor 110 may identify various information items, such as the location of an object located in an external environment, the user's identification information, the user's state, and information related to the user's feedback, by analyzing an image acquired through the camera module 125.

The driving device 126 may drive one or more wheels provided at the lower portion of the body of the robotic cleaner 101 such that the robotic cleaner 101 is capable of moving and/or turning in response to a control signal from the processor 110. For example, the driving device 126 may include one or more motors, and may allow the robotic cleaner 101 to move and/or turn by driving the motor in response to a control signal from the processor 110.

The cleaning device 128 may include a configuration that generates suction power for suctioning dust or the like. The cleaning device 128 may perform cleaning work in which foreign substances such as dust are suctioned from the floor surface on which the robotic cleaner 101 travels in response to a control signal of the processor 110. For example, the cleaning device 128 may include a dust bin (not illustrated), which stores collected dust, a suction fan (not illustrated), which provides power for suctioning dust or the like, and a suction motor (not illustrated), which rotates the suction fan so as to suction air.

According to an embodiment, the charging device 103 may include a processor 130, a communication interface 132, a sensor module 134, and a charging module 136. For example, the charging device 103 may detect the robotic cleaner 101 and may supply power to the robotic cleaner 101.

The processor 130 may execute, for example, an arithmetic operation or data processing related to control and/or communication of one or more other components of the electronic device 103.

The communication interface 132 may set, for example, communication between the charging device 103 and an external device (e.g., the robotic cleaner 101 and/or the robotic cleaner 107). For example, the communication interface 118 may be connected with a network (not illustrated) through wired or wireless communication so as to communicate with an external device (e.g., the robotic cleaner 101 and/or the robotic cleaner 107). For example, the processor 130 may communicate with the robotic cleaner 101 through the communication interface 132. For example, the processor 130 may transmit the location information of the charging device 103 through the communication interface 132. For example, the processor 130 may receive the location information of the robotic cleaner 101 through the communication interface 132.

The sensor module 134 may include, for example, a weight sensor, a QR code sensor, a barcode sensor, an infrared sensor, an ultrasonic sensor, a proximity sensor, an NFC, an RFID, and/or a camera. For example, the processor 130 may identify that the robotic cleaner 101 enters a charging region by analyzing an electrical signal or data value acquired through the sensor module 134.

The charging module 136 may supply power to the robotic cleaner 101 so as to charge the robotic cleaner 101. For example, the charging module 136 may wirelessly (contactlessly) supply power to the power module 120 (e.g., the battery 122) of the robotic cleaner 101. For example, when the robotic cleaner 101 enters the charging region, the processor 130 may supply power to the power module 120 (e.g., the battery 122) of the robotic cleaner 101 through the charging module 136.

According to an embodiment, the electronic device 105 may include a processor 150, a memory 152, an input/output interface 154, a display 156, and a communication interface 158.

The processor 150 may execute, for example, an arithmetic operation or data processing related to control and/or communication of one or more other components of the electronic device 105.

The memory 152 may include a volatile memory and/or a nonvolatile memory. The memory 152 may store, for example, commands or data related to one or more other components of the electronic device 105. According to an embodiment, the memory 152 may store software and/or a program (not illustrated).

The input/output interface 154 may transmit commands or data, which are input from, for example, the user or any other external device, to the other component(s) of the electronic device 105, or may output commands or data, which are received from the other component(s) of the electronic device 105, to the user or the other external device.

The display device 156 may include, for example, a liquid crystal display (LCD), a light-emitting diode (LED) display, an organic light-Emitting diode (OLED) display, a microelectromechanical system (MEMS) display, or an electronic paper display. The display 116 may display various contents (e.g., text, image, video, icon, or symbol) to, for example, the user. The display 116 may include a touch screen, and may receive touch input, gesture input, proximity input, or hovering input that is made using, for example, an electronic pen or a part of the user's body.

The communication interface 158 may set, for example, communication between the electronic device 105 and an external device (e.g., the robotic cleaner 101 and/or the robotic cleaner 107). For example, the communication interface 158 may be connected with a network (not illustrated) through wired or wireless communication so as to communicate with an external device (e.g., the robotic cleaner 101 and/or the robotic cleaner 107).

According to various embodiments, a robotic cleaner (e.g., the robotic cleaner 101) may include: a battery (e.g., the battery 122); a driving device (e.g., the driving device 126) configured to move the robotic cleaner; a cleaning device (e.g., the cleaning device 128) configured to allow the robotic cleaner to perform cleaning work; and a processor (e.g., the processor 110) configured to: determine a first zone in an entire space as an available cleaning zone in consideration of a residual capacity of the battery and a location of a charging device; and control a positional movement to the charging device while executing the cleaning work for the first zone by driving the driving device and the cleaning device.

According to various embodiments, the robotic cleaner is capable of receiving charging power from the charging device when located within a charging region of the charging device.

According to various embodiments, the processor may determine the first zone in the entire space as the available cleaning zone in consideration of the residual capacity of the battery and the location of the charging device when the residual capacity of the battery is a predetermined threshold or less during the execution of the cleaning work for the entire space.

According to various embodiments, the robotic cleaner may further include a display (e.g., the display 116), and the processor may perform control such that information about the first zone is displayed on the display.

According to various embodiments, the robotic cleaner may further include a communication interface (e.g., the communication interface 118), and the processor may perform control such that information about the first zone is transmitted to an external electronic device through the communication interface.

According to various embodiments, the robotic cleaner may further include a display (e.g., the display 116) and a communication interface (e.g., the communication interface 118). The processor may determine a completion time of the cleaning work for the first zone based at least in part on at least one of the residual capacity of the battery and information about the first zone, and may perform control such that at least one of an operation of displaying the determined completion time on the display and an operation of transmitting the determined completion time to an external electronic device through the communication interface is executed.

According to various embodiments, the robotic cleaner may further include an input interface (e.g., the input interface 114) and a communication interface (e.g., the communication interface 118). The processor may control the positional movement to the charging device while executing the cleaning work for a second zone by driving the driving device and the cleaning device when receiving a cleaning work command for the second zone through the input interface or the communication interface.

According to various embodiments, the robotic cleaner may further include a display (e.g., the display 116). The processor may determine whether the positional movement to the charging device is possible after completing cleaning of the second zone in consideration of the residual capacity of the battery and the location of the charging device when the cleaning work command for the second zone is received, and may perform control such that information corresponding to the determination is displayed on the display.

According to various embodiments, the processor may determine whether the positional movement to the charging device is possible after completing cleaning of the second zone in consideration of the residual capacity of the battery and the location of the charging device when receiving the cleaning work command for the second zone, and may perform control such that information corresponding to the determination is transmitted to an external electronic device through the communication interface.

According to various embodiments, the robotic cleaner may further include a communication interface (e.g., the communication interface 118). The processor may perform control such that information about the first zone is transmitted to an external first robotic cleaner through the communication interface.

According to various embodiments, the robotic cleaner may further include a communication interface (e.g., the communication interface 118). The processor may receive information about a second zone from an external first robotic cleaner through the communication interface, and may determine the first zone, which does not overlap the second zone in the entire space, as the available cleaning zone in consideration of the residual capacity of the battery, the location of the charging device, and information about the second zone.

According to various embodiments, the processor may perform control such that the information about the first zone and the information about the second zone are transmitted to an external second robotic cleaner through the communication interface.

Figure 2:
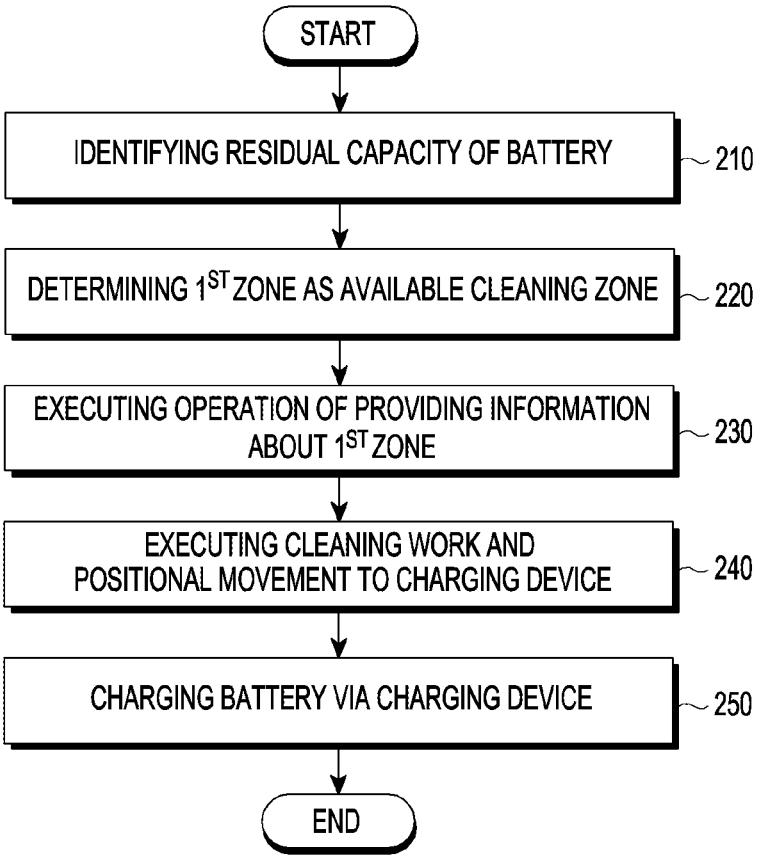
FIG. 2 is a flow chart of a control operation of a robotic cleaner according to various embodiments.
Figure 4B:
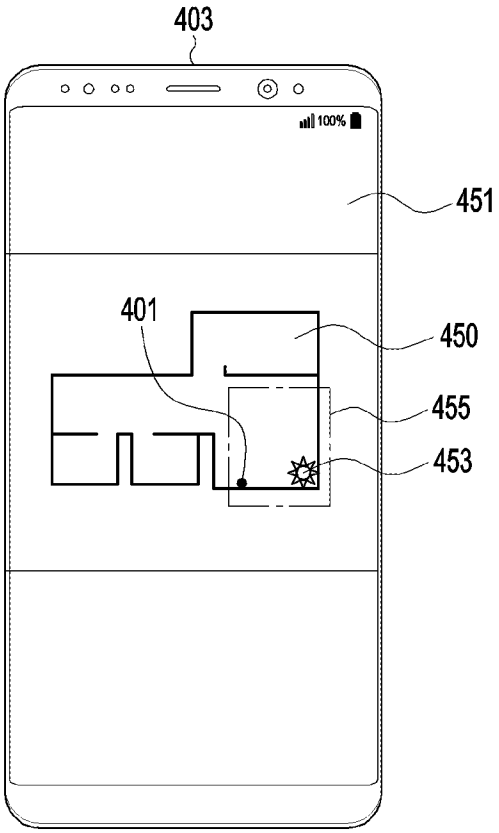
FIGS. 4A and 4B are views illustrating a display operation of a robotic cleaner and an electronic device according to various embodiments.
Figure 4A:
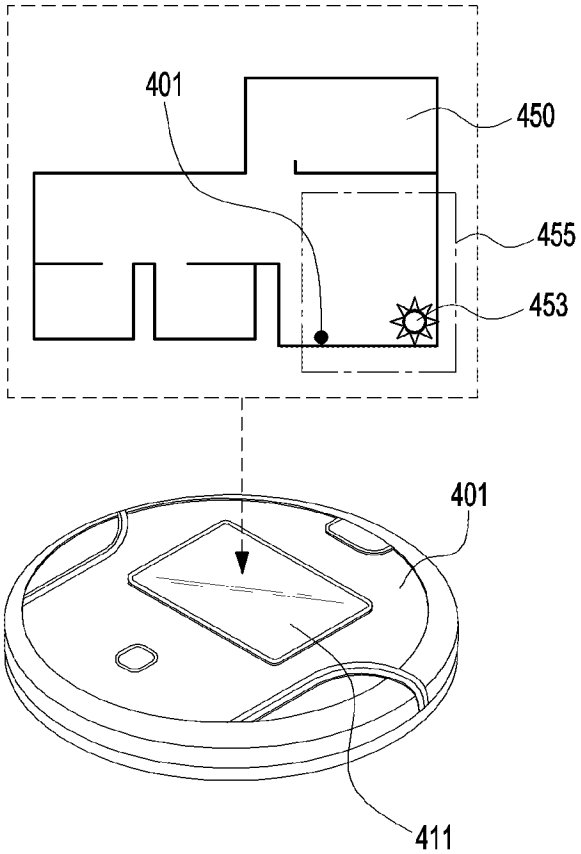
Figure 5:
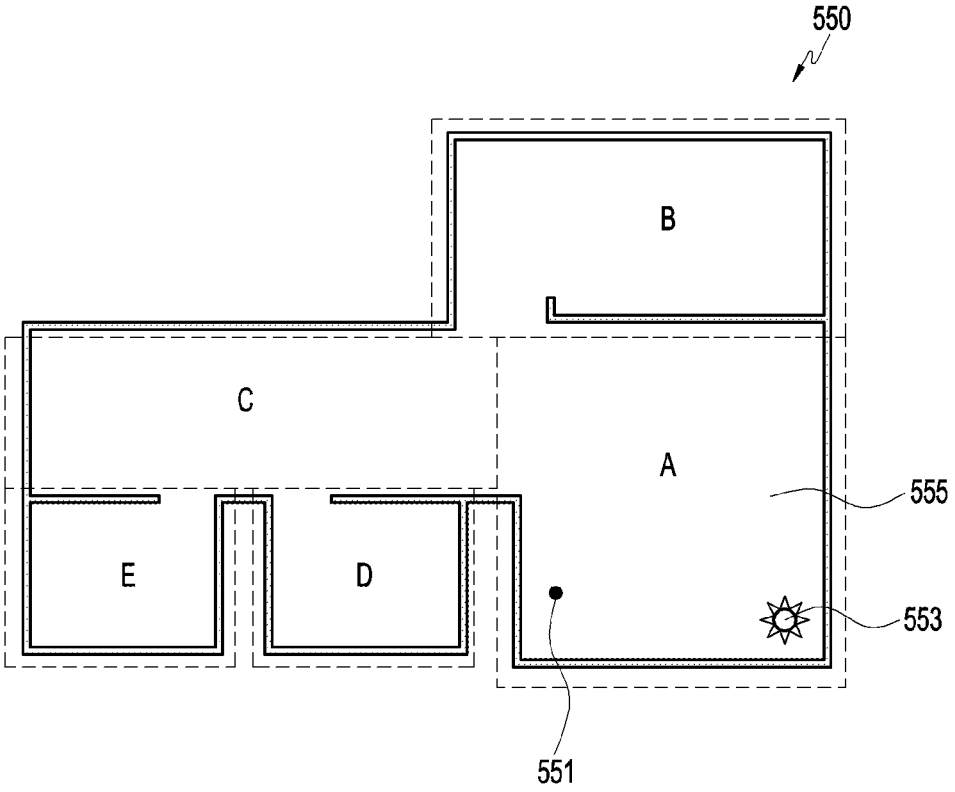
FIG. 5 is a view illustrating a map of the entire space to be cleaned by a robotic cleaner according to various embodiments.

FIG. 2 is a flowchart of a control operation of a robotic cleaner (e.g., the robotic cleaner 101, the processor 110 of the robotic cleaner, the robotic cleaner 107, or the processor (not illustrated) of the robotic cleaner 107) according to various embodiments of the disclosure. FIG. 3 is a view illustrating the operation of a robotic cleaner (e.g., the robotic cleaner 101, the processor 110 of the robotic cleaner 101, the robotic cleaner 107, or the processor (not illustrated) of the robotic cleaner 107) according to various embodiments of the disclosure. FIGS. 4A and 4B are views illustrating the display operation of a robotic cleaner (e.g., the robotic cleaner 101, the processor 110 of the robotic cleaner, the robotic cleaner 107, or the processor (not illustrated) of the robotic cleaner 107) and an electronic device (e.g., the electronic device 105 or the processor 150 of the electronic device) according to various embodiments of the disclosure. FIG. 5 is a map illustrating an entire space to be cleaned by a robotic cleaner (e.g., the robotic cleaner 101, the processor 110 of the robotic cleaner, the robotic cleaner 107, or the processor (not illustrated) of the robotic cleaner 107) according to various embodiments of the disclosure.

A robotic cleaner may execute cleaning work of an available cleaning zone, estimated in advance based on the residual capacity of the battery (e.g., the battery 122) before executing the cleaning operation and/or the positional movement to the charging device (e.g., the charging device 103) such that the battery of the robotic cleaner can be charged.

Figure 3A:
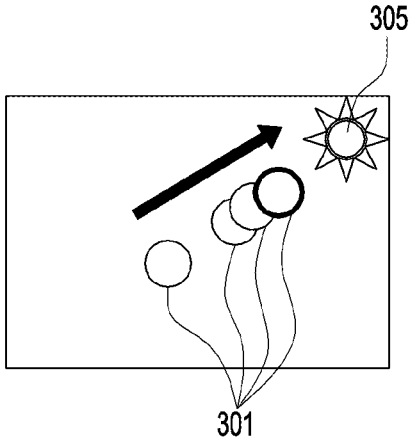
FIGS. 3A and 3B are views illustrating an operation of a robotic cleaner according to various embodiments.
Figure 3B:
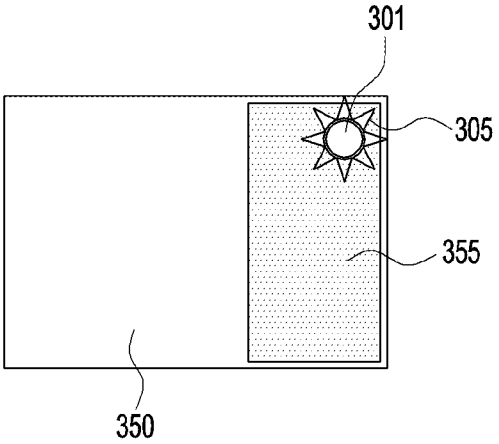

For example, conventionally, as illustrated in FIG. 3A, a robotic cleaner 301 (e.g., the robotic cleaner 101) often stops before reaching the charging device 305 (e.g., the charging device 103) due to the discharge of the battery (e.g., the battery 122) during the execution of the cleaning work. According to the embodiment of FIG. 2, in order to solve this problem, as illustrated in FIG. 3B, the robotic cleaner 301 may estimate in advance an available cleaning zone in the entire space 350 to be cleaned, and may execute the cleaning work for the first zone 355, which is the estimated available cleaning zone, and the positional movement to the charging device 305 (e.g., the charging device 103) for charging the battery.

In operation 210 of FIG. 2, the robotic cleaner may identify the residual capacity of the battery.

According to an embodiment, the robotic cleaner may identify the residual capacity of the battery before executing cleaning work. For example, the robotic cleaner may identify the residual capacity of the battery when receiving a cleaning work execution command or when executing a predetermined cleaning work. For example, receiving the cleaning work execution command may include receiving a signal from an external electronic device (e.g., the electronic device 105) through a communication interface (e.g., the communication interface 118) or receiving a user input through an input/output interface (e.g., the input/output interface 114).

In operation 220 in FIG. 2, the robotic cleaner may determine the first zone as an available cleaning zone based on the identified residual capacity of the battery.

According to an embodiment, the robotic cleaner may determine the first zone as the available cleaning zone using information about the space to be cleaned based on the identified residual capacity of the battery.

For example, the information about the space to be cleaned may include information about the entire space to be cleaned, location information of the robotic cleaner, and/or location information of the charging device. The information about the entire space to be cleaned may be in the form of a map of the entire space to be cleaned.

For example, the map may be generated using information acquired through a sensor module (e.g., the sensor module 134) and/or a camera module (e.g., the camera module 125) during execution of one or more previous cleaning works. The robotic cleaner may generate the map by forming coordinates according to the positional movement of the robotic cleaner, using the cleaning start location as a reference point. As another example, the map may be received from an external electronic device through the communication interface.

For example, the location information of the robotic cleaner may be detected by the robotic cleaner through the sensor module and/or the camera module. For example, the robotic cleaner may be located in the charging region of the charging device.

For example, the location information of the charging device may be received from the charging device through the communication interface, may be received from the user through the input/output interface, may be detected through the sensor module and/or the camera module of the robotic cleaner, or may be received from an external electronic device through the communication interface.

For example, in the entire space to be cleaned, the robotic cleaner may estimate a first zone from which the robotic cleaner is movable to the charging device (e.g., the charging device 103) while performing cleaning (or after cleaning) before battery drainage, and may determine the first zone as an available cleaning zone. The robotic cleaner may calculate an available cleaning time (or an available movement time) and/or an available cleaning distance (or an available movement distance) based on the identified residual capacity of the battery. For example, based on the result of the above calculation, the robotic cleaner may estimate a first zone from which the robotic cleaner is movable to the charging device while performing cleaning before battery drainage using the location information of the robotic cleaner and the location information of the charging device and may determine the first zone as an available cleaning zone. For example, the first zone may be the entire space to be cleaned, or at least a partial zone of the entire space to be cleaned.

In operation 230 of FIG. 2, the robotic cleaner may execute an operation of providing the information about the first zone.

According to an embodiment, the robotic cleaner may display information of the first zone on the display of the robotic cleaner. Referring to FIG. 4A, a robotic cleaner 401 (e.g., the robotic cleaner 101) may display a map 450 of the entire space to be cleaned on a display 411 (e.g., the display 110). For example, in the map 450, the location of the robotic cleaner 401, the location of the charging device 453 (e.g., the charging device 103), and/or the location of the first zone 455 may be indicated to be visually distinguished from each other.

According to another embodiment, the robotic cleaner may be communicatively connected to an external electronic device through a communication interface, and may execute an operation of providing information about the first zone through the electronic device. For example, the robotic cleaner may transmit at least one of information items about the space to be cleaned and/or information about the first zone, to the electronic device through the communication interface. For example, the information about the space to be cleaned may include information about the entire space to be cleaned, location information of the robotic cleaner, and/or location information of the charging device. The information about the entire space to be cleaned may be in the form of a map of the entire space to be cleaned. For example, when transmitting at least one of the information items of the space to be cleaned and/or the information about the first zone, the robotic cleaner may transmit a text, an image, or a combination thereof (e.g., an image form in which the location of the first zone is drawn), a text of a device identifier of the robotic cleaner, and/or a text of a location identifier of the robotic cleaner to the electronic device through a communication interface. For example, at least one of the map of the entire space to be cleaned by the robotic cleaner or location information of the charging device may be stored in advance in the electronic device. Referring to FIG. 4B, the electronic device 403 (e.g., the electronic device 105) may receive the information transmitted by the robotic cleaner 401, and may display the information about the first zone on the display 451 (e.g., the display 156) of the electronic device 403, as illustrated in FIG. 4B. The electronic device 403 may display the map 450 of the entire space to be cleaned on the display 451, and in the map 450, the location of the robotic cleaner 401, the location of the charging device 453, and/or the location of the first zone 455 may be indicated to be visually distinguished from each other.

In operation 240 of FIG. 2, the robotic cleaner may execute the cleaning work for the first zone and the positional movement to the charging device using the information about the first zone.

According to an embodiment, the execution of the cleaning work for the first zone may include the positional movement operation of the robotic cleaner and/or the cleaning operation of the robotic cleaner based on the information about the first zone.

According to an embodiment, the robotic cleaner may execute the cleaning work for the first zone and the positional movement to the charging device based on a predetermined travel pattern (or a predetermined algorithm).

According to another embodiment, the robotic cleaner may determine the travel pattern using the information about the first zone, and may execute the cleaning work for the first zone and the positional movement to the charging device based on the determined travel pattern.

For example, the predetermined travel pattern or the determined travel pattern may be at least one of various travel patterns, such as a travel pattern that forms orthogonal trajectories and consequently forms matrix-shaped trajectories.

For example, the robotic cleaner may finally move to the charging device while executing the cleaning work for the first zone based on the predetermined travel pattern or the determined travel pattern. The robotic cleaner may complete the cleaning work for entire of the first zone before reaching the location of the charging device.

As another example, based on the predetermined travel pattern or the determined travel pattern, the robotic cleaner may execute the cleaning work for the first zone, and may move to the location of the charging device after completing the execution of the cleaning work for the first zone. For example, when completing the execution of the cleaning work for the first zone, the robotic cleaner may change the mode of the robotic cleaner into a power-saving mode, and move to the charging device in the state of the power-saving mode. For example, the power-saving mode may be set to perform a movement operation to the charging device without executing the cleaning work.

In operation 250 of FIG. 2, the robotic cleaner may cause the battery thereof to be charged by the charging device.

According to an embodiment, when the robotic cleaner enters the charging region of the charging device, the charging device may start charging the battery of the robotic cleaner. For example, when the robotic cleaner is detected in the charging region, the charging device may identify whether the robotic cleaner is a chargeable device. When it is identified that the robotic cleaner is a chargeable device, the charging device may start charging the robotic cleaner.

According to an embodiment, when the battery charging of the robotic cleaner is started through the charging device, the robotic cleaner may calculate a charging completion time based on charging information such as the battery capacity of the robotic cleaner and the rated power of the charging device. For example, the robotic cleaner may output the calculated charging completion time through the display and the speaker of the robotic cleaner. As another example, the robotic cleaner may transmit the calculated charging completion time through a communication connection with an external electronic device. The electronic device may output the calculated charging completion time through the display of the electronic device and/or the speaker of the electronic device.

According to another embodiment, when the battery charging of the robotic cleaner is started through the charging device, the charging device may transmit the charging information to an electronic device, and the electronic device may calculate a charging completion time based on the charging information. For example, the electronic device may output the calculated charging completion time through the display and/or the speaker of the electronic device. As another example, the electronic device may transmit the calculated charging completion time through a communication connection with the robotic cleaner. The robotic cleaner may output the calculated charging completion time through the display and the speaker of the robotic cleaner.

In the above-described embodiment of FIG. 2, it has been described that the information about the first zone is output through the display of the robotic cleaner and/or the display of an external electronic device communicatively connected to the robotic cleaner. However, according to another embodiment, the information about the first zone may be output through a speaker of the robotic cleaner and/or a speaker of the electronic device. Referring to FIG. 5, the map 550 of the entire space to be cleaned may be divided into one or more zones, and names (e.g., A, B, C, D, and E) may be assigned to respective zones, and the location of the robotic cleaner 551 and the location of the charging device 553 may be indicated to be visually distinguished. For example, when the first zone determined by the robotic cleaner is a zone 555 having name A, a voice, such as "zone A will be cleaned", may be output through the speaker of the robotic cleaner and/or the speaker of the electronic device using the name "A".

In the embodiment described above with reference to FIG. 2, an operation of providing information about an available cleaning zone through the display of the robotic cleaner and/or the display of an external electronic device communicatively connected to the robotic cleaner has been described. However, according to another embodiment, it is possible to execute an operation of providing available cleaning time information (or information about a time before battery drainage or cleaning end time information) through the display of the robotic cleaner, the speaker of the robotic cleaner, the display of the electronic device, and/or the speaker of the electronic device.

In the embodiment described with reference to FIG. 2, the robotic cleaner determines the first zone as an available cleaning zone based on the residual capacity of the battery, and may execute cleaning work for the first zone and a positional movement to the charging device. However, according to another embodiment, when only the positional movement to the charging device is possible with the identified residual capacity of the battery, the robotic cleaner may directly perform the positional movement to the charging device without executing the cleaning work so as to allow the battery to be charged. According to still another embodiment, when the positional movement to the charging device as well as the cleaning work is impossible with the identified residual capacity of the battery, the robotic cleaner may not execute the cleaning work and the positional movement to the charging device.

According to an embodiment, the robotic cleaner may acquire at least some of information items about the space to be cleaned through the sensor module and/or the camera module during execution of the cleaning work in the embodiment of FIG. 2. For example, when the robotic cleaner stores the information items about the space to be cleaned, the stored information items about the space to be cleaned may be updated through comparison with the at least some of acquired information items. As another example, the robotic cleaner may transmit the at least some of acquired information to an external electronic device through a communication interface.

Figure 6:
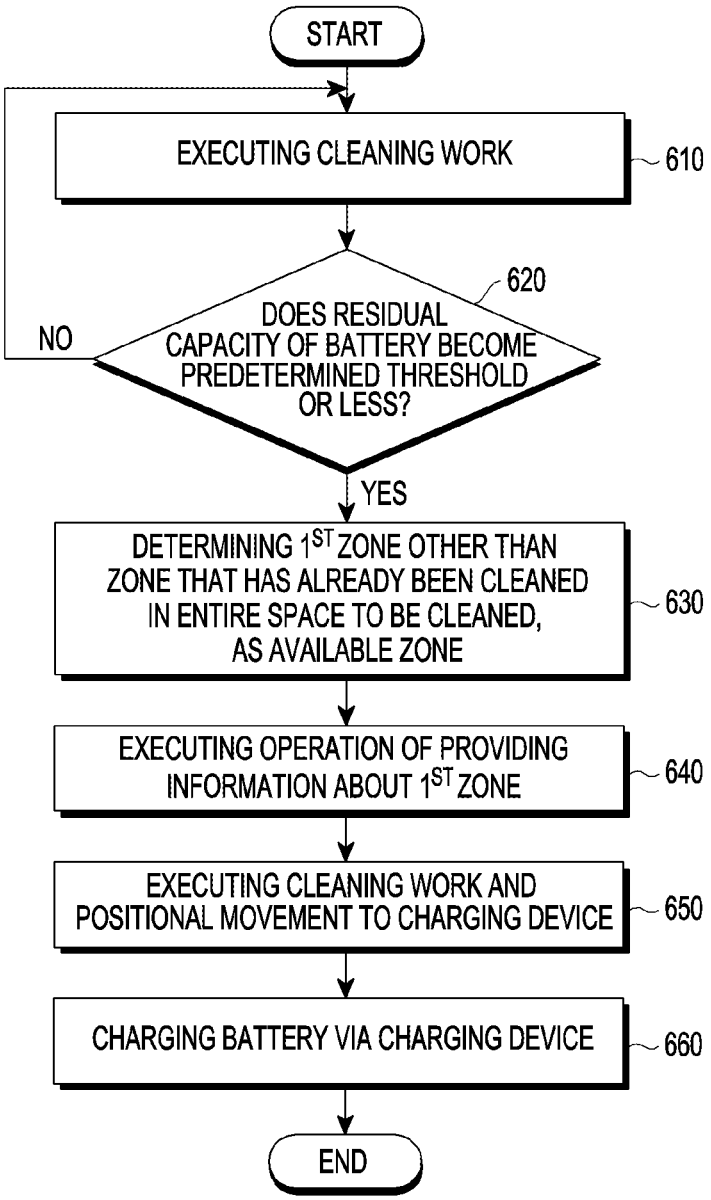
FIG. 6 is a flow chart of a control operation of a robotic cleaner according to various embodiments.
Figure 7B:
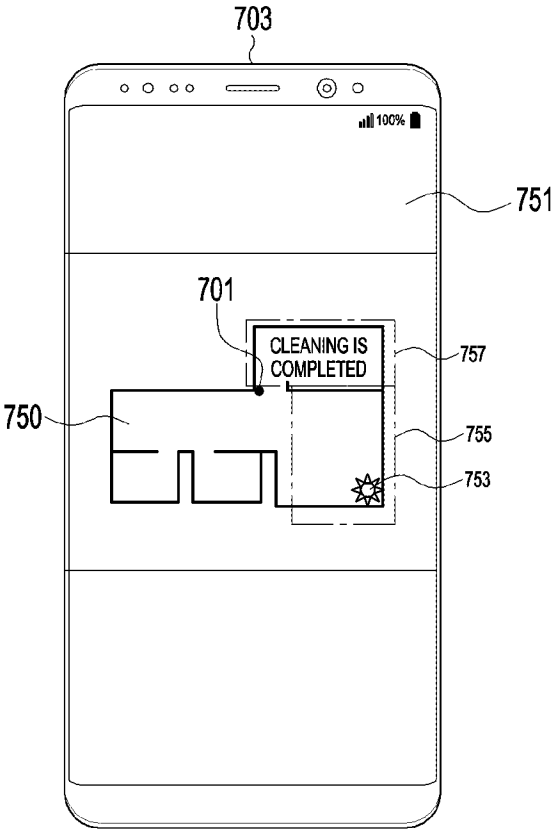
FIGS. 7A and 7B are views illustrating a display operation of a robotic cleaner and an electronic device according to various embodiments.
Figure 7A:
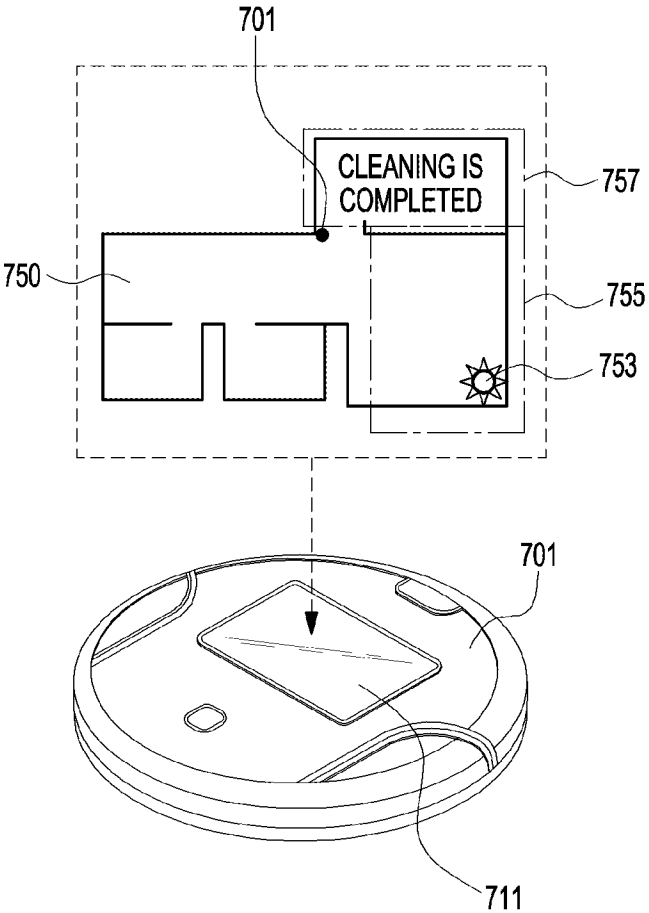

FIG. 6 is a flowchart of a control operation of a robotic cleaner (e.g., the robotic cleaner 101, the processor 110 of the robotic cleaner, the robotic cleaner 107, or the processor (not illustrated) of the robotic cleaner 107) according to various embodiments of the disclosure. FIGS. 7A and 7B are views illustrating the display operation of a robotic cleaner (e.g., the robotic cleaner 101, the processor 110 of the robotic cleaner, the robotic cleaner 107, or the processor (not illustrated) of the robotic cleaner 107) and an electronic device (e.g., the electronic device 105 or the processor 150 of the electronic device) according to various embodiments of the disclosure.

When the robotic cleaner identifies that the residual capacity of the battery (e.g., the battery 122) becomes a predetermined threshold or less during the execution of the cleaning work, the robotic cleaner may determine a first zone that can be cleaned with the residual capacity of the battery as an available cleaning zone, and may execute the cleaning work for the first zone and the positional movement to the charging device (e.g., the charging device 103) so that the battery of the robotic cleaner can be charged. For example, based on the residual capacity of the battery, the robotic cleaner may perform the positional movement to the charging device while executing the cleaning operation without stopping operation due to the discharge of the battery so as to allow the battery to be charged.

In operation 610, the robotic cleaner may execute cleaning work.

According to an embodiment, the robotic cleaner may execute cleaning operation for the entire space to be cleaned at the time of receiving a cleaning operation execution command or executing a predetermined cleaning work. For example, receiving the cleaning work execution command may include receiving a signal from an external electronic device (e.g., the electronic device 105) through a communication interface (e.g., the communication interface 118) or receiving a user input through an input/output interface (e.g., the input/output interface 114). For example, the execution of the cleaning work may include the positional movement operation of the robotic cleaner and/or the cleaning operation of the robotic cleaner.

According to an embodiment, the robotic cleaner may execute the cleaning work based on a predetermined travel pattern (or a predetermined algorithm).

According to another embodiment, the robotic cleaner may determine information about the entire space to be cleaned, and may execute the cleaning work based on the determined travel pattern. For example, the information about the space to be cleaned may include information about the entire space to be cleaned, location information of the robotic cleaner, and/or location information of the charging device. The information about the entire space to be cleaned may be in the form of a map of the entire space to be cleaned.

In operation 620, the robotic cleaner may determine whether the residual capacity of the battery becomes a predetermined threshold or less.

When it is determined that the residual capacity of the battery of the robotic cleaner becomes a predetermined threshold or less, the robotic cleaner may execute operation 630. Otherwise, the robotic cleaner may execute operation 610.

According to an embodiment, the predetermined threshold value may be determined and/or changed based on the size of the space to be cleaned by the robotic cleaner, and/or the rated voltage of the robotic cleaner.

In operation 630, the robotic cleaner may determine a first available cleaning zone, other than a zone that has already been cleaned, in the space to be cleaned, as an available cleaning zone, based on the residual capacity of the battery.

According to one embodiment, the robotic cleaner may determine a first available cleaning zone, other than a zone that has already been cleaned, in the space to be cleaned using the residual capacity of the battery, as an available cleaning zone, based on the information about the space to be cleaned.

For example, the information about the space to be cleaned may include information about the entire space to be cleaned, information about the zone that has already been cleaned according to operation 610, location information of the robotic cleaner, and/or location information of the charging device. The information about the entire space to be cleaned may be in the form of a map of the entire space to be cleaned.

For example, the robotic cleaner may estimate a first zone from which the robotic cleaner is movable to the charging device (e.g., the charging device 103) in the remaining space, other than the zone that has been already cleaned according to operation 610, in the entire space to be cleaned while performing cleaning (or after cleaning) before battery drainage, and may determine the first zone as an available cleaning zone. The robotic cleaner may calculate (or identify) an available cleaning time (or an available movement time) and/or an available cleaning distance (or an available movement distance) corresponding to the identified residual capacity of the battery. For example, based on the available cleaning time (or the available movement time) and/or the available cleaning distance (or the available movement distance) corresponding to the residual capacity of the battery, the robotic cleaner may determine a first zone in the remaining space from which the robotic cleaner is movable to the charging device before battery drainage while cleaning (or after cleaning) using the location information of the robotic cleaner and the location information of the charging device, as an available cleaning area. The first zone may be, for example, the entire remaining space, or at least a partial zone in the remaining space.

In operation 640, the robotic cleaner may execute an operation of providing the information about the determined first zone.

According to an embodiment, the robotic cleaner may display information about the first zone on the display of the robotic cleaner. Referring to FIG. 7A, a robotic cleaner 701 (e.g., the robotic cleaner 101) may display a map 750 of the entire space to be cleaned on a display 711 (e.g., the display 110). For example, in the map 750, the location of the robotic cleaner 701, the location of the charging device 753 (e.g., the charging device 103), the location of the first zone 755, and/or the location of the zone 757 that has already been cleaned may be indicated to be visually distinguished from each other.

According to another embodiment, the robotic cleaner may be communicatively connected to an external electronic device through a communication interface, and may execute an operation of providing information about the first zone through the electronic device.

For example, the robotic cleaner may transmit information about the space to be cleaned, information about the first zone, and information about the zone that has already been cleaned, to the electronic device through the communication interface. As another example, a map of the entire space to be cleaned by the robotic cleaner may be previously stored in the electronic device. The robotic cleaner may transmit location information of the robotic cleaner, location information of the charging device, information about the first zone, and information about the zone that has already been cleaned, to the electronic device through the communication interface. As another example, a map of the entire space to be cleaned by the robotic cleaner and location information of the charging device may be previously stored in the electronic device. The robotic cleaner may transmit location information of the robotic cleaner, location information of the first zone, and information about the zone that has already been cleaned, to the electronic device through the communication interface.

The electronic device may receive the information transmitted by the robotic cleaner, and may display the information about the first zone on a display 751 (e.g., the display 156) of the electronic device 703 (e.g., the electronic device 105) as illustrated in FIG. 7B. Referring to FIG. 7B, the electronic device 703 may display a map 750 of the entire space to be cleaned on a display 751. For example, in the map 750, the location of the robotic cleaner 701, the location of the charging device 753, the location of the first zone 755, and/or the location of the zone 757 that has already been cleaned may be indicated to be visually distinguished from each other.

In operation 650, the robotic cleaner may execute the cleaning work for the first zone and the positional movement to the charging device using the information about the first zone.

According to an embodiment, the execution of the cleaning work for the first zone may include the positional movement operation of the robotic cleaner and/or the cleaning operation of the robotic cleaner based on the information about the first zone.

According to an embodiment, the robotic cleaner may execute the cleaning work for the first zone and the positional movement to the charging device based on a predetermined travel pattern (or a predetermined algorithm).

According to another embodiment, the robotic cleaner may determine the travel pattern using the information about the first zone, and may execute the cleaning work for the first zone and the positional movement to the charging device based on the determined travel pattern.

In operation 660, the robotic cleaner may cause the battery thereof to be charged by the charging device.

According to an embodiment, when the robotic cleaner enters the charging region of the charging device, the charging device may start charging the battery of the robotic cleaner.

According to an embodiment, during execution of the above-described operations of FIG. 6, for example, operations 620, 630, and 640, the robotic cleaner may temporarily suspend the cleaning work and/or the movement operation or may continuously execute the cleaning work and/or the movement operation.

In the embodiment described above with reference to FIG. 6, an operation of providing information about an available cleaning zone through the display of the robotic cleaner and/or the display of an external electronic device communicatively connected to the robotic cleaner has been described. However, according to another embodiment, it is possible to execute an operation of providing available cleaning time information (or information about a time before battery drainage or cleaning end time information) through the display of the robotic cleaner, the speaker of the robotic cleaner, the display of the electronic device, and/or the speaker of the electronic device.

Figure 8:
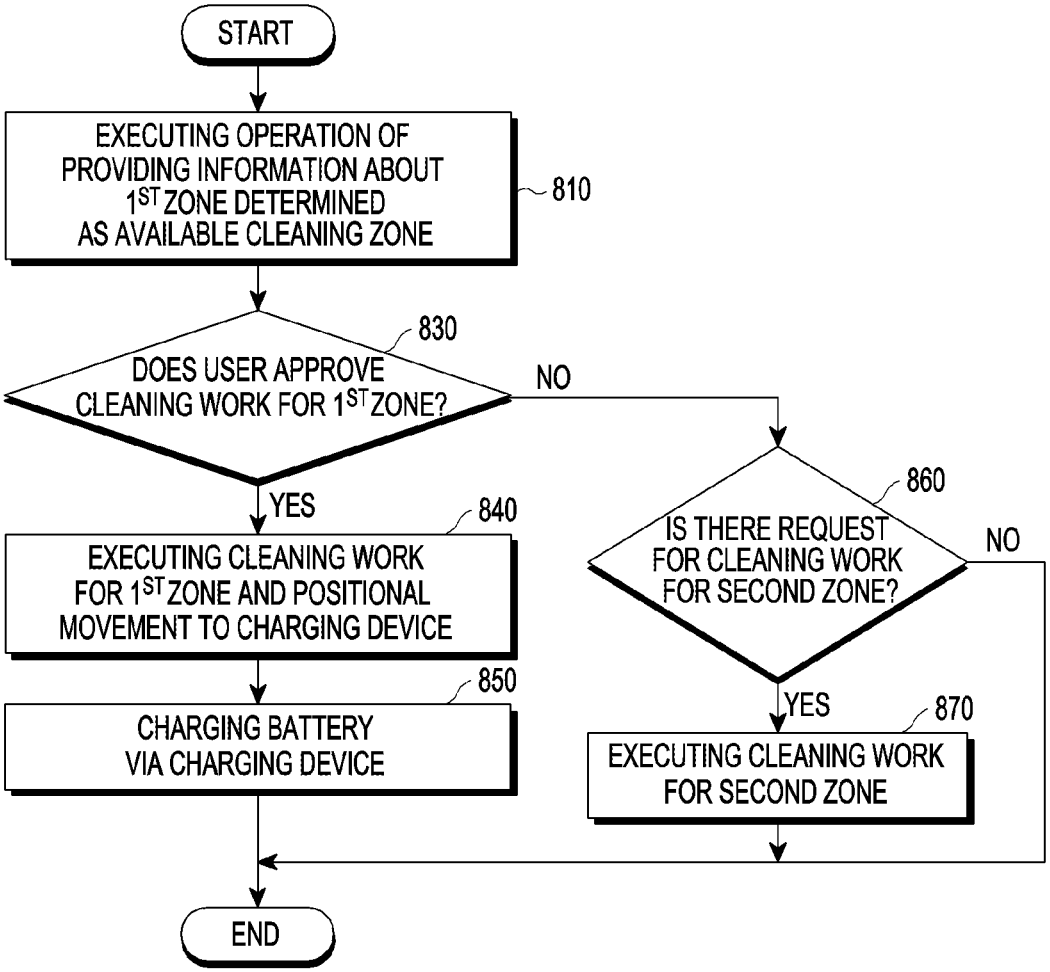
FIG. 8 is a flow chart of a control operation of a robotic cleaner according to various embodiments.
Figure 9A:
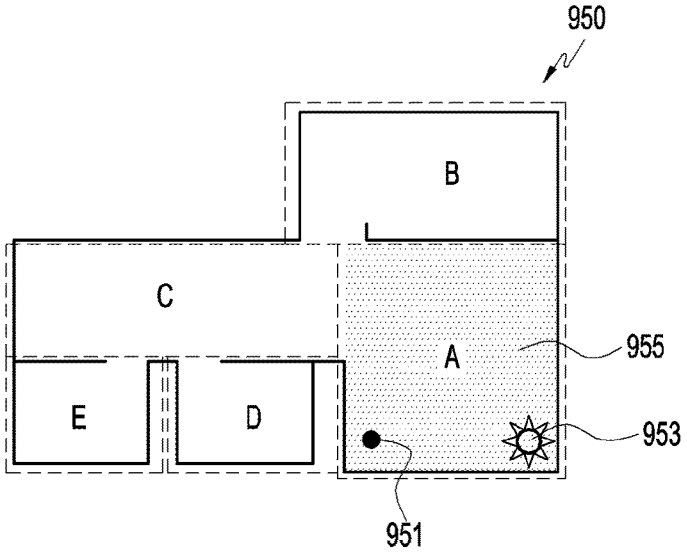
FIGS. 9A, 9B, and 9C are views illustrating selection of a cleaning zone using a map of an entire space to be cleaned according to various embodiments.
Figure 9B:
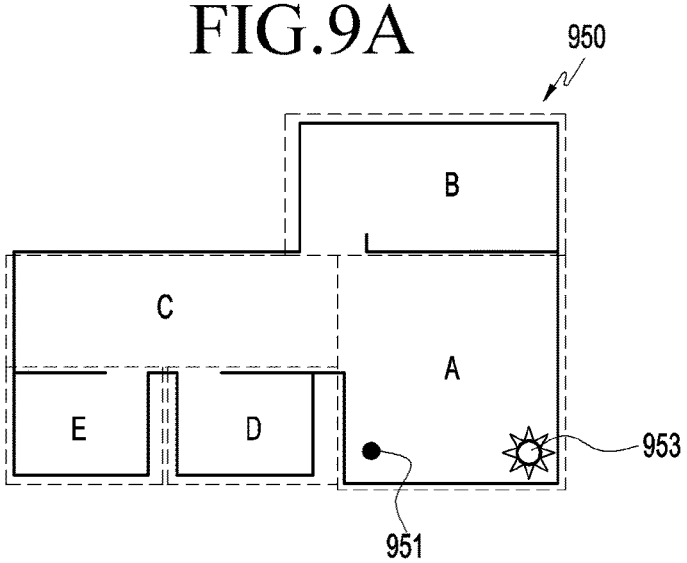
Figure 9C:
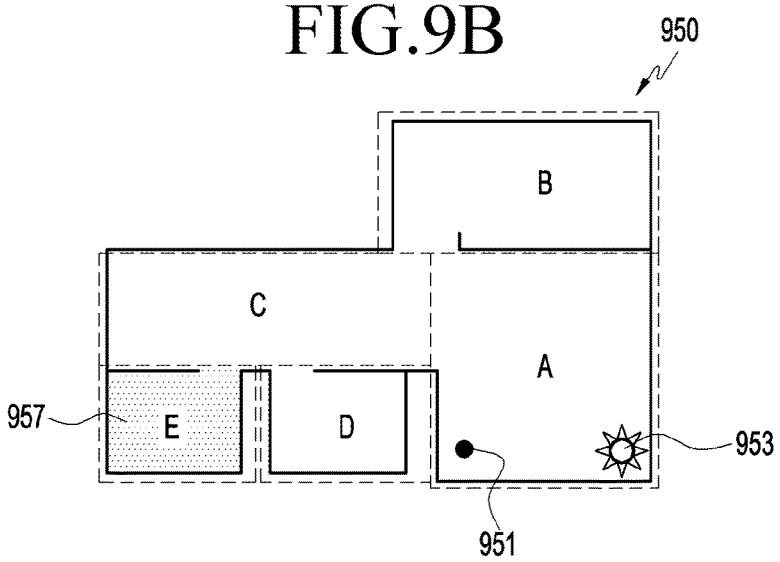

FIG. 8 is a flowchart of a control operation of a robotic cleaner (e.g., the robotic cleaner 101, the processor 110 of the robotic cleaner, the robotic cleaner 107, or the processor (not illustrated) of the robotic cleaner 107) according to various embodiments of the disclosure. FIGS. 9A to 9C are views illustrating selection of a cleaning zone using a map of an entire space to be cleaned according to various embodiments.

Referring to FIG. 8, the robotic cleaner may determine the first zone as an available cleaning zone based on the residual capacity of the battery thereof (e.g., the battery 122), and based on user approval for the cleaning work in the first zone, the robotic cleaner may cause the battery thereof to be charged by executing the cleaning work for the first zone and the positional movement to the charging device (e.g., the charging device 103).

In operation 810, the robotic cleaner may execute an operation of providing the information about the first zone determined as the available cleaning zone.

According to an embodiment, as in the embodiment of FIG. 2, the robotic cleaner may identify the residual capacity of the battery before executing the cleaning operation, and may determine the first zone as an available cleaning zone based on the identified residual capacity of the battery. The operation of identifying the residual capacity of the battery and the operation of determining the first zone as an available cleaning zone have been described in detail above with reference to FIG. 2, and thus will be omitted.

According to an embodiment, as in the embodiment of FIG. 6, when the residual capacity of the battery becomes a predetermined threshold or less during the execution of the cleaning work, the robotic cleaner may determine the first zone, other than the zone that has already been cleaned, in the entire space to be cleaned, as an available cleaning zone based on the residual capacity of the battery thereof. The operation of determining the first zone, other than the zone that has already been cleaned, in the entire space to be cleaned, as a first available cleaning zone has been described in detail with reference to FIG. 6, and thus will be omitted.

According to an embodiment, as in the embodiment of FIG. 2 or the embodiment of FIG. 6, the robotic cleaner may output information of the first zone through the display thereof and/or a display of an external electronic device communicatively connected thereto.

According to another embodiment, the robotic cleaner may display a map of the entire space to be cleaned by the robotic cleaner as illustrated in FIG. 9A on the display of the robotic cleaner. According to another embodiment, the robotic cleaner may be communicatively connected to an external electronic device through a communication interface, and the electronic device may display a map of the entire space to be cleaned by the robotic cleaner as illustrated in FIG. 9A. Referring to FIG. 9A, the map 950 of the entire space to be cleaned may be divided into one or more zones, and names (e.g., A, B, C, D, and E) may be assigned to respective zones. In addition, in the map 950, the location of the robotic cleaner 951, the location of the charging device 953, and/or the location of the first zone 955 may be indicated to be visually distinguished from each other.

In operation 830, the robotic cleaner may identify whether the user approves the cleaning work for the first zone.

According to an embodiment of the disclosure, when executing the operation of providing information about the first zone, the robotic cleaner may provide user approval request information for the cleaning work of the first zone.

For example, the robotic cleaner may also display information about an execution approval request for the cleaning work for the first zone while displaying the information about the first zone on the display thereof. The robotic cleaner may receive a user input corresponding to approval or rejection of execution of the cleaning work for the first zone through the input/output interface thereof, and may identify whether there is a user's approval.

As another example, the robotic cleaner may be communicatively connected to an external electronic device through a communication interface, and may transmit information about the first zone to the electronic device. The electronic device may also display information about an execution approval request for the cleaning work for the first zone while displaying the information about the first zone on the display thereof. The electronic device may receive a user input corresponding to approval or rejection of execution of the cleaning work for the first zone through an input/output interface, and may transmit information corresponding to approval or rejection of execution of the cleaning work for the first zone to the robotic cleaner through a communication interface. The robotic cleaner may receive information corresponding to approval or rejection of execution of the cleaning work for the first zone from the electronic device, and may identify whether there is a user's approval.

When it is identified that there is the user's approval for the cleaning work for the first zone, the robotic cleaner may execute operation 840, and when it is identified that there is the user's rejection with respect to the cleaning work of the first zone, the robotic cleaner may execute operation 860.

In operation 840, the robotic cleaner may execute the cleaning work for the first zone and the positional movement to the charging device using the information about the first zone.

According to an embodiment, the execution of the cleaning work for the first zone may include the positional movement operation of the robotic cleaner and/or the cleaning operation of the robotic cleaner based on the information about the first zone.

According to an embodiment, the robotic cleaner may execute the cleaning work for the first zone and the positional movement to the charging device based on a predetermined travel pattern (or a predetermined algorithm).

According to another embodiment, the robotic cleaner may determine the travel pattern using the information about the first zone, and may execute the cleaning work for the first zone and the positional movement to the charging device based on the determined travel pattern.

In operation 850, the robotic cleaner may cause the battery thereof to be charged by the charging device.

According to an embodiment, when the robotic cleaner enters the charging region of the charging device, the charging device may start charging the battery of the robotic cleaner.

In operation 860, the robotic cleaner may identify whether there is a request for cleaning work for a second zone.

According to an embodiment, the robotic cleaner may receive a user input corresponding to the request for the cleaning work for the second zone through an input/output interface thereof.

According to another embodiment, the robotic cleaner may receive the request for the cleaning work for the second zone from an external electronic device through a communication interface. For example, the electronic device may receive a user input corresponding to the request for the cleaning work for the second zone through the input/output interface thereof. Based on the user input corresponding to the cleaning work request for the second zone, the electronic device may transmit information corresponding to the cleaning work request for the second zone, to the robotic cleaner through a communication interface.

According to an embodiment, after operation 810, on the display of the robotic cleaner and/or the display of the electronic device, a map 950 of the entire space to be cleaned, which includes information about the first zone 951 as illustrated in FIG. 9A, may be displayed or a map 950 of the entire space to be cleaned, which does not include information about the first zone 951, may be displayed as illustrated in FIG. 9B. For example, when a user input (e.g., a touch, drag, or a voice command) that selects zone E 950 as the second zone is received through the input/output interface of the robotic cleaner in the state in which a screen illustrated in FIG. 9A or FIG. 9B is displayed on the display of the robotic cleaner, a visual effect may be applied to the selected E zone 957 as illustrated in FIG. 9C. For example, when a user input (e.g., a touch, drag, or a voice command) that selects zone E 950 as the second zone is received through the input/output interface of the electronic device in the state in which the screen illustrated in FIG. 9A or FIG. 9B is displayed on the display of the electronic device, a visual effect may be applied to the selected zone E 957 as illustrated in FIG. 9C, and information indicating that the zone E 957 is selected as the second zone may be transmitted to the robotic cleaner.

In operation 870, the robotic cleaner may execute cleaning work for the second zone.

According to an embodiment, the execution of the cleaning work for the second zone may include the positional movement operation of the robotic cleaner and/or the cleaning operation of the robotic cleaner based on the information about the second zone.

According to an embodiment, the robotic cleaner may operate based on a predetermined travel pattern (or a predetermined algorithm) or a travel pattern determined using information about the second zone. For example, depending on the residual capacity of the battery, the robotic cleaner may stop operation before completion of the cleaning work for the second zone or may stop operation during movement to the charging device after completion of the cleaning work for the second zone. As another example, depending on the residual capacity of the battery, the robotic cleaner may complete the cleaning work for the second zone and may move to the location of the charging device so as to allow the battery to be charged by the charging device.

In the embodiment described above with reference to FIG. 8, it has been described that the cleaning work for the second zone is performed when there is a cleaning work request for the second zone. However, according to another embodiment, when there is a cleaning work request for the second zone, the robotic cleaner may determine whether it is possible to complete the cleaning work for the second zone and/or whether it is possible to move to the location of the charging device while completing the cleaning work for the second zone (or after the completion of the cleaning work for the second zone) based on the residual capacity of the battery using location and size information of the second zone, location information of the robotic cleaner, and/or location information of the charging device. The robotic cleaner may execute an operation of providing the information corresponding to the determination. For example, the robotic cleaner may execute display of the information corresponding to the determination on the display, output of the information corresponding to the determination through a speaker, and/or transmission of the information corresponding to the determination to an external electronic device communicatively connected thereto through a communication interface.

In the embodiment described above with reference to FIG. 8, it has been described that the cleaning work for the second zone is performed when there is a cleaning work request for the second zone. However, according to another embodiment, when there is a cleaning work request for the second zone, the robotic cleaner may determine whether it is possible to complete the cleaning work for the second zone and/or whether it is possible to move to the location of the charging device while completing the cleaning work for the second zone (or after the completion of the cleaning work for the second zone). The robotic cleaner may perform an operation of requesting identification from the user as to whether to perform the cleaning work for the second zone while performing the operation for providing the result of the determination. The robotic cleaner may execute the cleaning work for the second zone based on the user's response to the identification request. For example, when the robotic cleaner outputs the information corresponding to the determination through the display and/or the speaker, the robotic cleaner may also output information for requesting identification from the user as to whether to perform the cleaning work for the second zone. In response to the identification request, the robotic cleaner may receive an execution command for the cleaning work for the second zone from the user through the input/output interface or the communication interface thereof, and may execute the cleaning work for the second zone based on the command. In response to the identification request, the robotic cleaner may receive a command not to perform the cleaning work the second zone from the user through the input/output interface or the communication interface thereof. The robotic cleaner may not execute the cleaning work for the second zone based on the command.

In the embodiment described above with reference to FIG. 8, an operation of providing information about an available cleaning zone through the display of the robotic cleaner and/or the display of an external electronic device communicatively connected to the robotic cleaner has been described. However, according to another embodiment, the robotic cleaner may execute an operation of providing an available cleaning time (an available movement time, a time before battery drainage, or a cleaning end time) calculated based on the residual capacity of the battery. For example, it is possible to execute an operation of providing information about an available cleaning time (an available movement time, a time before battery drainage, or a cleaning end time) through the display of the robotic cleaner, the speaker of the robotic cleaner, the display of the electronic device, and/or the speaker of the electronic device.

Figure 10:
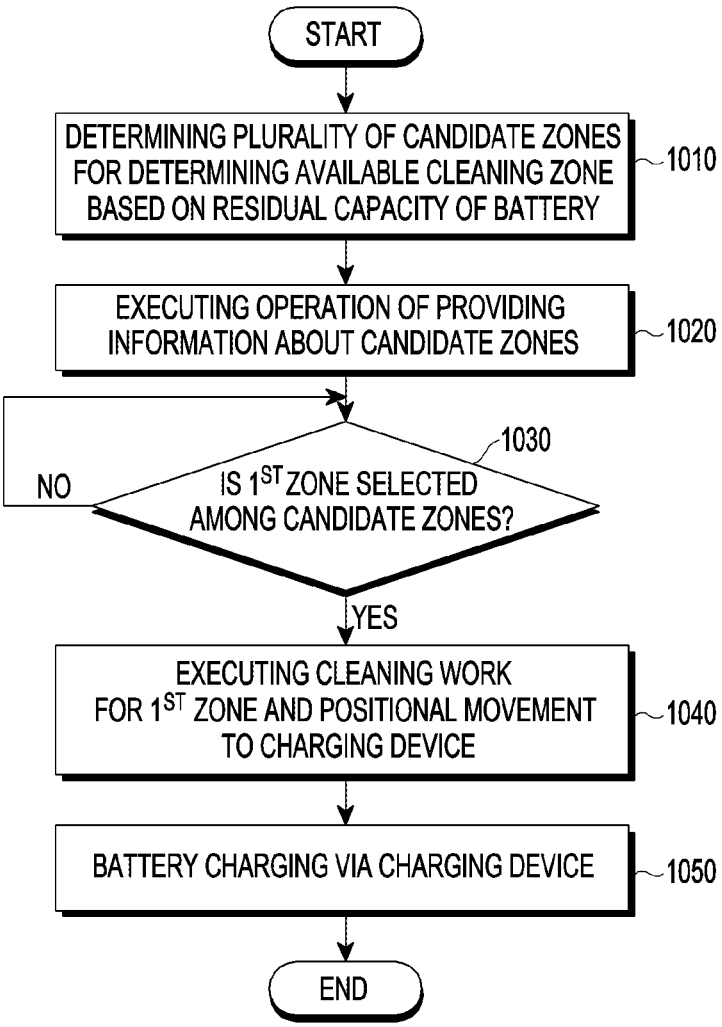
FIG. 10 is a flow chart of a control operation of a robotic cleaner according to various embodiments.
Figure 11:
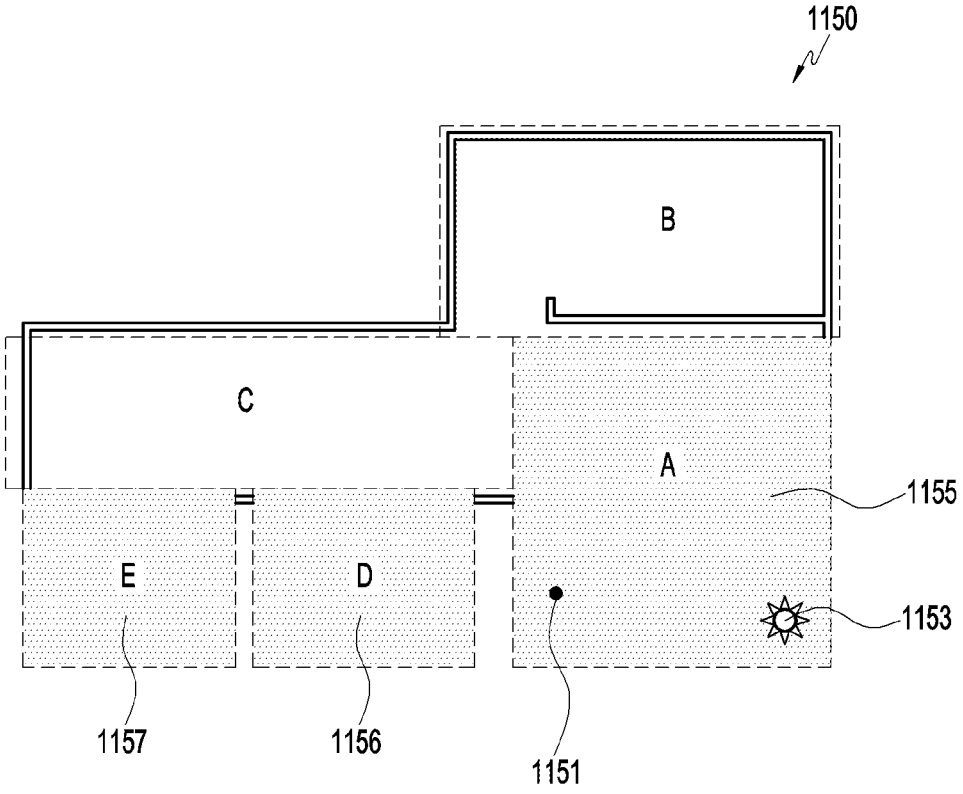
FIG. 11 is a view illustrating an operation of determining, by a robotic cleaner, a first zone among a plurality of candidate zones as an available cleaning zone according to various embodiments.

FIG. 10 is a flowchart of a control operation of a robotic cleaner (e.g., the robotic cleaner 101, the processor 110 of the robotic cleaner, the robotic cleaner 107, or the processor (not illustrated) of the robotic cleaner 107) according to various embodiments of the disclosure. FIG. 11 is a view illustrating an operation of determining, by a robotic cleaner (e.g., the robotic cleaner 101, the processor 110 of the robotic cleaner 101, the robotic cleaner 107, or the processor (not illustrated) of the robotic cleaner 107) according to various embodiments, a first zone as an available cleaning zone among a plurality of candidate zones.

Referring to FIG. 10, the robotic cleaner may determine a plurality of candidate zones for determining an available cleaning zone based on the residual capacity of the battery (e.g., the battery 122), and based on the user's selection of the first zone among the plurality of candidate zones, the robotic cleaner may execute cleaning work of the first zone and a positional movement to a charging device (e.g., the charging device 103) so as to allow the battery of the robotic cleaner to be charged.

In operation 1010, the robotic cleaner may determine a plurality of candidate zones for determining an available cleaning zone based on the residual capacity of the battery.

According to an embodiment, the robotic cleaner may operate as in the embodiment of FIG. 2 so as to identify the residual capacity of the battery before executing the cleaning work, and may determine a plurality of candidate zones for determining an available cleaning zone based on the identified residual capacity of the battery.

According to another embodiment, the robotic cleaner may operate as in the embodiment of FIG. 6, and when the residual capacity of the battery becomes a predetermined threshold or less during the execution of the cleaning work, the robotic cleaner may determine a plurality of candidate zones for determining an available cleaning zone, other than the zone that has already been cleaned, in the entire space to be cleaned, based on the residual capacity of the battery thereof.

In operation 1020, the robotic cleaner may execute an operation of providing information about the candidate zones.

According to another embodiment, the robotic cleaner may display a map of the entire space to be cleaned by the robotic cleaner as illustrated in FIG. 11 on the display of the robotic cleaner.

According to another embodiment, the robotic cleaner may be communicatively connected to an external electronic device through a communication interface, and the electronic device may display a map of the entire space to be cleaned by the robotic cleaner as illustrated in FIG. 11.

Referring to FIG. 11, the map 1150 of the entire space to be cleaned may be divided into one or more zones, and names (e.g., A, B, C, D, and E) may be assigned to respective zones. In addition, in the map 1150, the location of the robotic cleaner 1151, the location of the charging device 1153, and/or the locations of the candidate zones 1155, 1156, and 1157 may be indicated to be visually distinguished from each other.

In operation 1030, the robotic cleaner may determine whether to select a first zone, which is one of the candidate zones.

The robotic cleaner may perform operation 1040 when the first zone is selected among the candidate zones. Otherwise, the robotic cleaner may execute operation 1030 again.

According to an embodiment, in the map 1150 in which the candidate zones 1155, 1156, and 1157 are indicated on the display of the robotic cleaner as illustrated in FIG. 11, the first zone may be selected among the candidate zones 1155, 1156, and 1157 based on the reception of a user input (e.g., a touch, drag, or a voice command), and the robotic cleaner is capable of identifying that the first zone is selected.

According to another embodiment, in the map 1150 in which the candidate zones 1155, 1156, and 1157 are indicated on the display of an external electronic device as illustrated in FIG. 11, the first zone may be selected among the candidate zones 1155, 1156, and 1157 based on the reception of a user input (e.g., a touch, drag, or a voice command). The electronic device may transmit information about the selected first zone to the robotic cleaner through a communication interface. Based on the information received from the electronic device, the robotic cleaner may identify the selection of the first zone.

In operation 1040, the robotic cleaner may execute the cleaning work for the first zone and the positional movement to the charging device.

According to an embodiment, the execution of the cleaning work for the first zone may include the positional movement operation of the robotic cleaner and/or the cleaning operation of the robotic cleaner based on the information about the first zone.

According to an embodiment, the robotic cleaner may execute the cleaning work for the first zone and the positional movement to the charging device based on a predetermined travel pattern (or a predetermined algorithm).

According to another embodiment, the robotic cleaner may determine the travel pattern using the information about the first zone, and may execute the cleaning work for the first zone and the positional movement to the charging device based on the determined travel pattern.

In operation 1050, the robotic cleaner may cause the battery thereof to be charged by the charging device.

According to an embodiment, when the robotic cleaner enters the charging region of the charging device, the charging device may start charging the battery of the robotic cleaner.

Figure 12A:
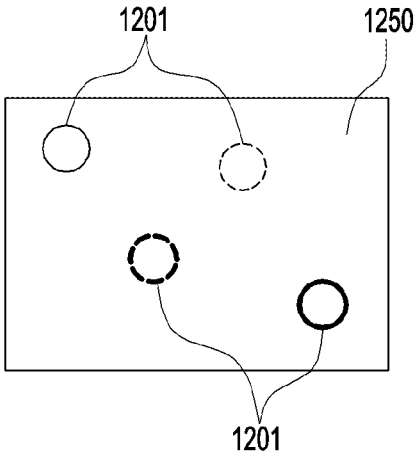
FIGS. 12A and 12B are views illustrating a control operation of a robotic cleaner according to various embodiments in comparison with a conventional robotic cleaner.
Figure 12B:
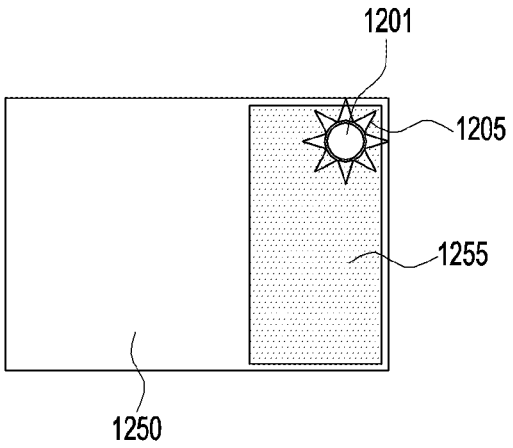

FIGS. 12A and 12B are views illustrating a control operation of a robotic cleaner (e.g., the robotic cleaner 101, the processor 110 of the robotic cleaner, the robotic cleaner 107, or the processor (not illustrated) of the robotic cleaner 107) according to various embodiments in comparison with a conventional robotic cleaner.

According to the embodiments described with reference to FIGS. 2 to 11, the user may identify in advance a first zone capable of being cleaned by the robotic cleaner and/or an available cleaning time of the robotic cleaner based on the residual capacity of the battery of the robotic cleaner.

For example, the conventional robotic cleaner does not estimate a first zone capable of being cleaned with the remaining capacity of the battery in the entire space to be cleaned and/or the time at which the operation of the robotic cleaner ends due to battery drainage. For example, conventionally, as illustrated in FIG. 12A, a robotic cleaner 1201 performs cleaning work based on the current location thereof in the entire space 1250 to be cleaned without considering the residual capacity of the battery thereof.

Accordingly, it is impossible for a user to accurately identify the information of the area to be cleaned by the robotic cleaner 1201 and/or the cleaning end time. However, according to the above-described embodiments of FIGS. 2 to 11, as illustrated in FIG. 12B, the robotic cleaner 1201 (e.g., the robotic cleaner 101) may determine information about the first zone 1255 to be capable of being cleaned with the residual capacity of the battery in the entire space 1250 to be cleaned/and an available cleaning time, and may provide the determined information to the user. Due to this operation of the robotic cleaner 1201, the user may identify in advance an operation for the cleaning work of the robotic cleaner 1201.

Figure 13:
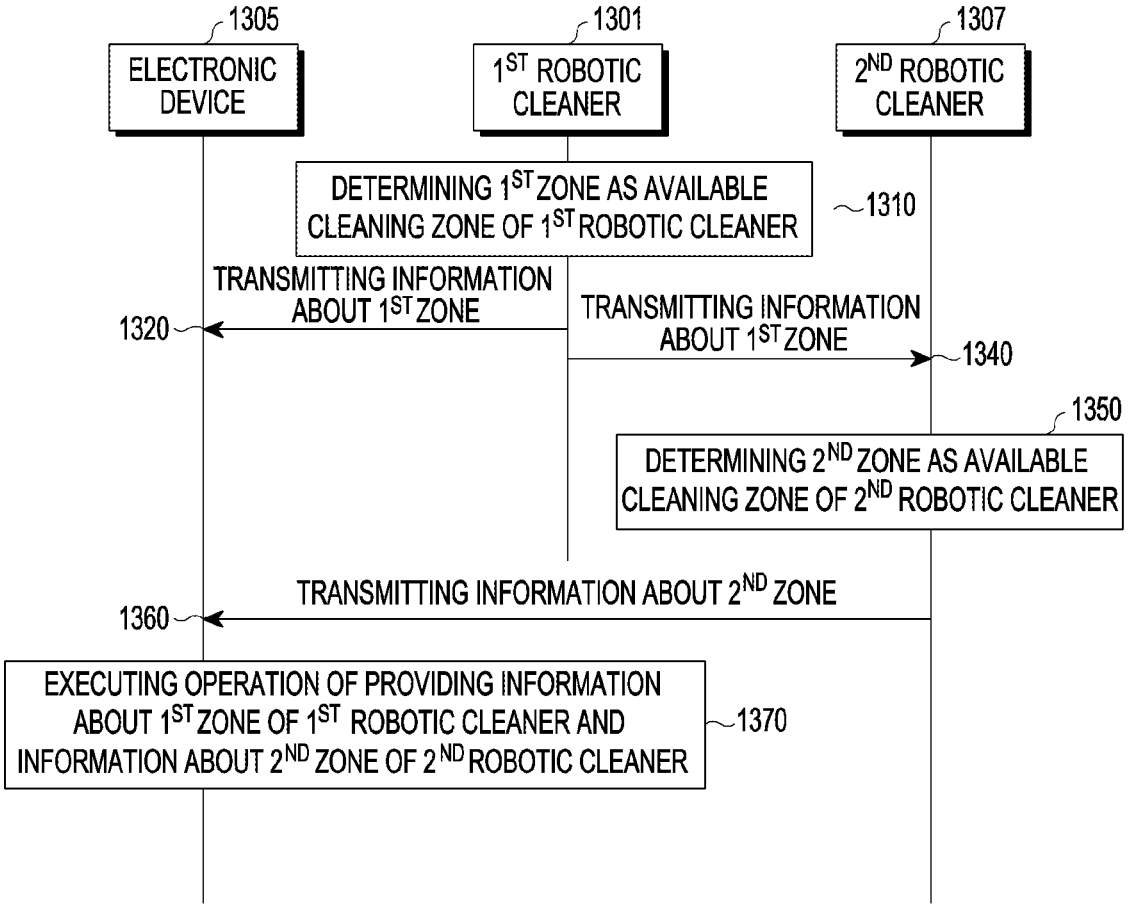
FIG. 13 is a flow chart of control operations of a plurality of robotic cleaners according to various embodiments.
Figure 14A:
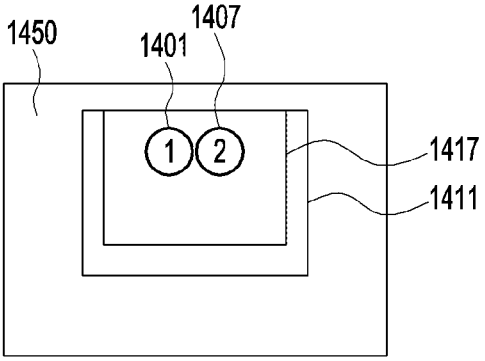
FIGS. 14A, 14B, and 14C are views illustrating operations of a plurality of robotic cleaners according to various embodiments.
Figure 14B:
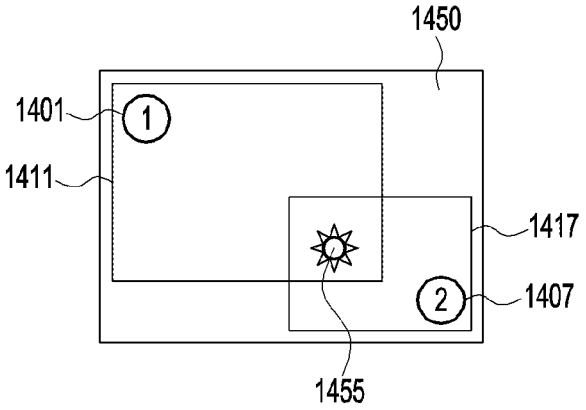
Figure 14C:
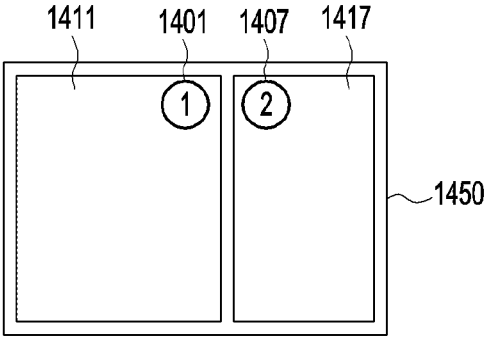
Figure 15:
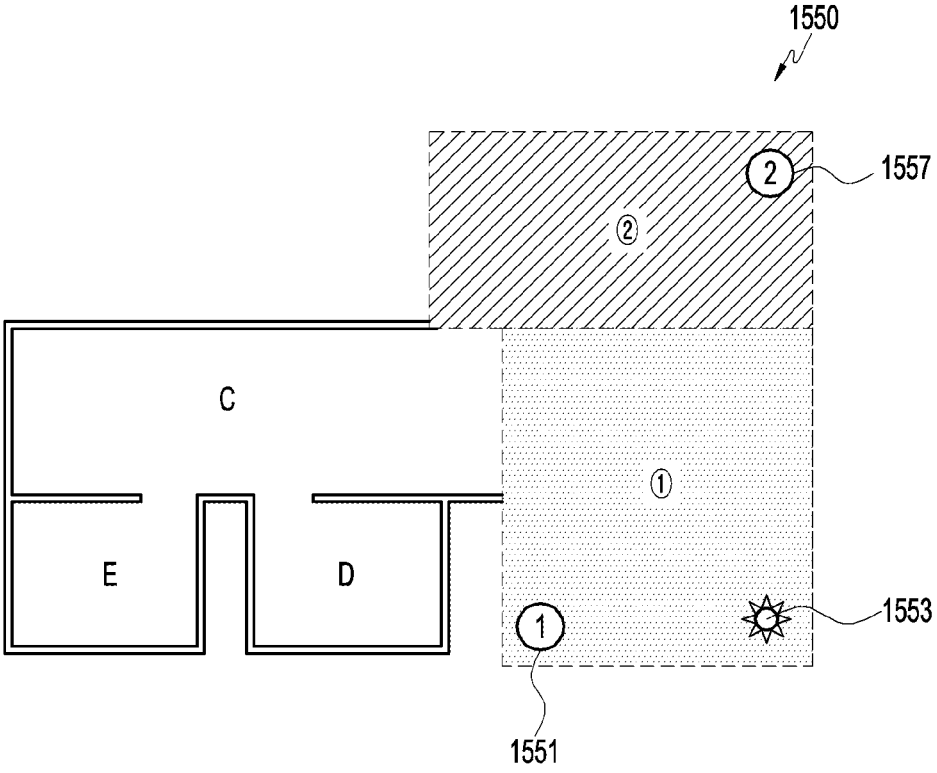
FIG. 15 is a view illustrating an operation of providing zones to be cleaned by a plurality of robotic cleaners according to various embodiments.

FIG. 13 is a flowchart of control operations of a plurality of robotic cleaners (e.g., the robotic cleaner 101, the processor 110 of the robotic cleaner, the robotic cleaner 107, or the processor (not illustrated) of the robotic cleaner 107) according to various embodiments. FIGS. 14A to 14C are views illustrating operations of a plurality of robotic cleaners (e.g., the robotic cleaner 101, the processor 110 of the robotic cleaner, the robotic cleaner 107, or the processor (not illustrated) of the robotic cleaner 107) according to various embodiments. FIG. 15 is a view illustrating an operation of providing zones to be cleaned by a plurality of robotic cleaners (e.g., the robotic cleaner 101, the processor 110 of the robotic cleaner, the robotic cleaner 107, or the processor (not illustrated) of the robotic cleaner 107) according to various embodiments.

Referring to FIG. 13, a plurality of robotic cleaners may set respective available cleaning zones based on the residual capacities of the batteries thereof. For example, each of the plurality of robotic cleaners may set an available cleaning zone based on the residual capacity of the battery thereof regardless of the location of the charging device (e.g., the charging device 103).

For example, conventionally, when a plurality of robotic cleaners 1401 and 1407 clean a specific space 1450 as illustrated in FIG. 14A, depending on the locations of the robotic cleaners, the cleaning zones of the robotic cleaners 1401 and 1407 may overlap. Referring to FIG. 14A, in a specific space 1450A, a first robotic cleaner 1401 cleans the first zone 1411, a second robotic cleaner 1407 cleans a second zone 1417, which is a part of the first zone 1411, and thus the cleaning zones overlap.

For example, conventionally, as illustrated in FIG. 14B, for charging the first robotic cleaner 1401 and the second robotic cleaner 1407, there is a disadvantage in that a charging device 1455 should be installed in a zone in which the first zone 1411 to be cleaned by the first robotic cleaner 1401 and the second zone 1417 to be cleaned by the second robotic cleaner 1407 overlap.

According to the embodiment of FIG. 13, in order to solve the above-described conventional disadvantage, the robotic cleaners 1411 and 1417 may execute cleaning work such that the cleaning zones 1401 and 1407 do not overlap based on the residual capacity of the battery of each of the robotic cleaners 1401 and 1407, as illustrated in FIG. 14C. Although not illustrated in FIG. 14C, the installation location of the charging device 1455 may also be freely determined by the user in consideration of spatial efficiency compared to the prior art.

In operation 1310, the first robotic cleaner 1301 may determine the first zone as an available cleaning zone of the first robotic cleaner 1201.

According to an embodiment, the first robotic cleaner 1301 may operate like the robotic cleaner of the embodiment of FIG. 2 so as to determine the first zone in the entire space to be cleaned as an available cleaning zone thereof. For example, the first robotic cleaner 1301 may execute an operation for identifying the residual capacity of the battery and an operation of determining the first zone as an available cleaning zone of the first robotic cleaner 1301 based on the identified residual capacity of the battery.

According to another embodiment, the first robotic cleaner 1301 may operate as in the embodiment of FIG. 6 so as to determine the first zone as an available cleaning zone thereof. For example, when the residual capacity of the battery becomes a predetermined threshold or less during execution of the cleaning work, the first robotic cleaner 1301 may perform an operation of determining a first zone capable of being cleaned, other than a zone that has already been cleaned, in the entire space to be cleaned, as an available cleaning zone of the first robotic cleaner 1301 based on the residual capacity of the battery.

In operation 1320, the first robotic cleaner 1301 may transmit information about the first zone to the electronic device 1305.

According to an embodiment, the first robotic cleaner 1301 may be communicatively connected to the electronic device 1305 through a communication interface, and may transmit information about the first zone to the electronic device 1305.

In operation 1340, the first robotic cleaner 1301 may transmit the information about the first zone to the second robotic cleaner 1307.

According to an embodiment, the first robotic cleaner 1301 may be communicatively connected to the second robotic cleaner 1307 through a communication interface, and may transmit the information about the first zone to the second robotic cleaner 1307.

In operation 1350, the second robotic cleaner 1307 may determine the second zone as an available cleaning zone thereof based on the information about the first zone.

According to an embodiment, the second robotic cleaner 1307 may determine the second zone in a region, other than the first zone, in the entire space to be cleaned, as an available cleaning zone thereof.

According to an embodiment, the second robotic cleaner 1307 may operate like the robotic cleaner of the embodiment of FIG. 2 so as to determine the second zone in a region, other than the first zone, in the entire space to be cleaned, as an available cleaning zone thereof. For example, the second robotic cleaner 1307 may execute an operation of identifying the residual capacity of the battery and an operation of determining the second zone in the region other than the first zone, as an available cleaning zone thereof based on the identified residual capacity of the battery.

According to another embodiment, the second robotic cleaner 1307 may determine the second zone in a region, other than the first zone and the space that has already been cleaned by the first robotic cleaner 1307, in the entire space to be cleaned, as an available cleaning zone thereof. For example, the information about the space that has already been cleaned by the first robotic cleaner 1307 may be transmitted together with or separately from the information about the first zone when transmitting the information about the first zone.

In operation 1360, the second robotic cleaner 1307 may transmit information about the second zone to the electronic device 1305.

According to an embodiment, the second robotic cleaner 1307 may be communicatively connected to the electronic device 1305 through a communication interface, and may transmit the information about the second zone to the electronic device 1305.

In operation 1370, the electronic device 1305 may execute the operation of providing the information about the first zone of the first robotic cleaner 1301 and the information about the second zone of the second robotic cleaner 1307.

According to an embodiment, the electronic device 1305 may display the information about the first zone of the first robotic cleaner 1301 and the information about the second zone of the second robotic cleaner 1307 on a display. For example, a map of the entire space to be cleaned by the first robotic cleaner 1301 and the second robotic cleaner 1307 may be stored in the electronic device 1305. As another example, the electronic device 1305 may receive the map from the first robotic cleaner 1301 and/or the second robotic cleaner 1307. For example, referring to FIG. 15, the electronic device 1305 may display a map 1550 in which the location of a first robotic cleaner 1551, the location of a second robotic cleaner 1557, the location of a charging device 1553, the location of a first zone ①, and the location of a second zone ② are visually distinguished from each other.

In the embodiment described above with reference to FIG. 13, it has been described that the first robotic cleaner 1301 transmits the information about the first zone to the electronic device 1305 and the second robotic cleaner 1307 transmits the information about the second zone to the electronic device 1305. However, according to another embodiment, the second robotic cleaner 1307 may transmit the information about the first zone and the information about the second zone to the electronic device 1305.

Figure 16:
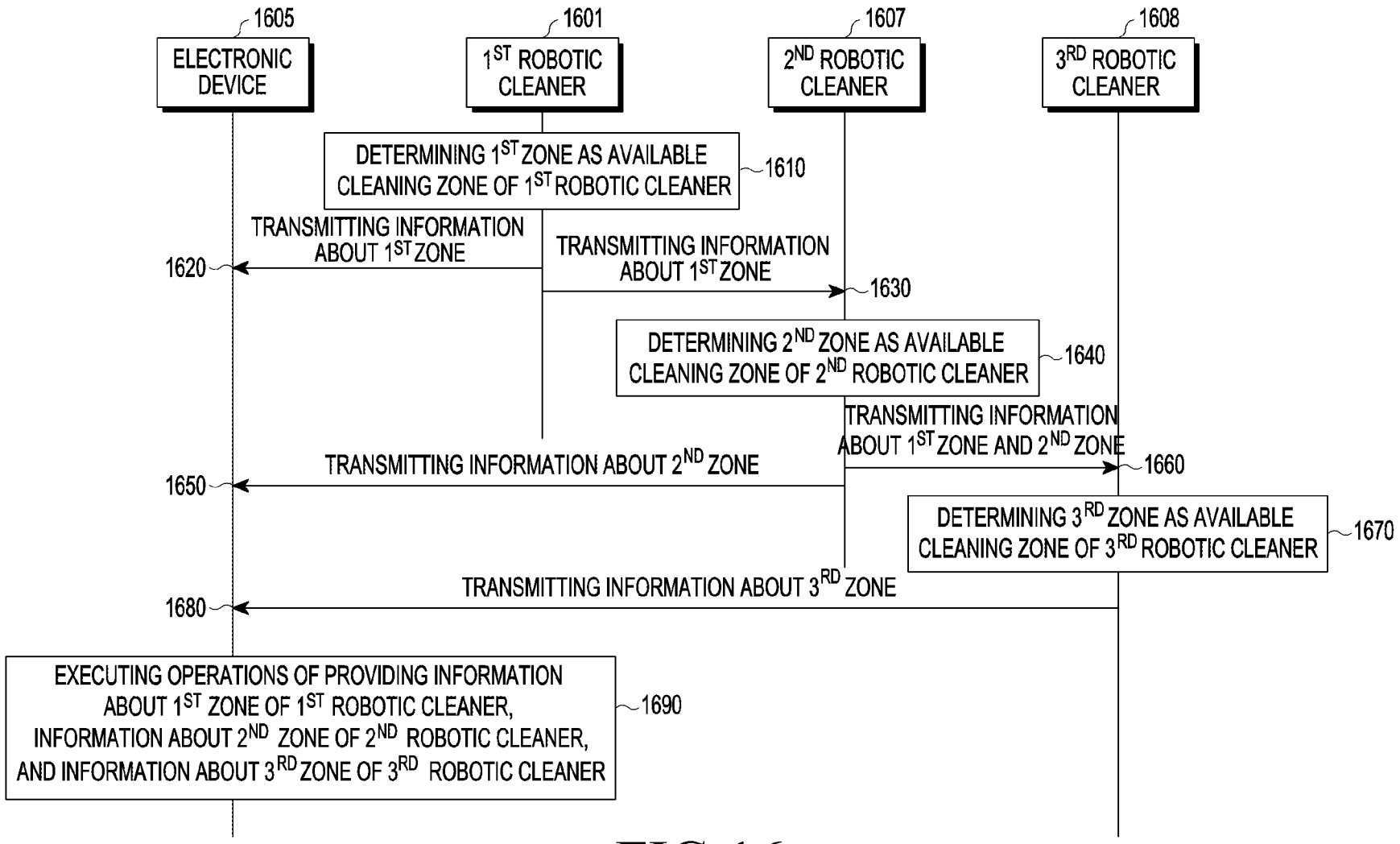
FIG. 16 is a flow chart of control operations of a plurality of robotic cleaners according to various embodiments.

FIG. 16 is a flowchart of control operations of a plurality of robotic cleaners (e.g., the robotic cleaner 101, the processor 110 of the robotic cleaner, the robotic cleaner 107, or the processor (not illustrated) of the robotic cleaner 107) according to various embodiments.

Referring to FIG. 16, a plurality of robotic cleaners may set respective available cleaning zones based on the residual capacities of the batteries thereof such that the available cleaning zones do not overlap. For example, the plurality of robotic cleaners may determine respective available cleaning zones in a sequential order. For example, the sequential order may be designated (or determined, or changed) depending on various criteria by a user, a robotic cleaner, or an electronic device. For example, the various criteria may include the locations of robotic cleaners, performance of robotic cleaners, and the like. For example, a first robotic cleaner 1601 may first determine a first zone as an available cleaning zone, then a second robotic cleaner 1607 may determine a second zone as an available cleaning zone, and then a third robotic cleaner 1608 may determine a third zone as an available cleaning zone.

In operation 1610, the first robotic cleaner 1601 may determine the first zone as an available cleaning zone of the first robotic cleaner 1601.

According to an embodiment, the first robotic cleaner 1601 may operate like the robotic cleaner of the embodiment of FIG. 2 so as to determine the first zone in the entire space to be cleaned as the available cleaning zone thereof. For example, the first robotic cleaner 1601 may execute an operation for identifying the residual capacity of the battery and an operation of determining the first zone as an available cleaning zone of the first robotic cleaner 1601 based on the identified residual capacity of the battery.

According to another embodiment, the first robotic cleaner 1601 may operate as in the embodiment of FIG. 6 so as to determine the first zone as an available cleaning zone thereof. For example, when the residual capacity of the battery becomes a predetermined threshold or less during execution of the cleaning work, the first robotic cleaner 1601 may perform an operation of determining a first zone capable of being cleaned, other than a zone that has already been cleaned, in the entire space to be cleaned, as an available cleaning zone of the first robotic cleaner 1601 based on the residual capacity of the battery.

In operation 1620, the first robotic cleaner 1601 may transmit information about the first zone to the electronic device 1605.

According to an embodiment, the first robotic cleaner 1601 may be communicatively connected to the electronic device 1605 through a communication interface, and may transmit information about the first zone to the electronic device 1605.

In operation 1630, the first robotic cleaner 1601 may transmit the information about the first zone to the second robotic cleaner 1607.

According to an embodiment, the first robotic cleaner 1601 may be communicatively connected to the second robotic cleaner 1607 through a communication interface, and may transmit information about the first zone to the second robotic cleaner 1607.

In operation 1640, the second robotic cleaner 1607 may determine the second zone as an available cleaning zone thereof based on the information about the first zone.

According to an embodiment, the second robotic cleaner 1607 may determine the second zone in a region, other than the first zone, in the entire space to be cleaned, as an available cleaning zone thereof.

According to an embodiment, the second robotic cleaner 1607 may operate like the robotic cleaner of the embodiment of FIG. 2 so as to determine the second zone in a region, other than the first zone, in the entire space to be cleaned, as an available cleaning zone thereof. For example, the second robotic cleaner 1607 may execute an operation of identifying the residual capacity of the battery and an operation of determining the second zone in the region other than the first zone, as an available cleaning zone thereof based on the identified residual capacity of the battery.

According to another embodiment, the second robotic cleaner 1607 may determine the second zone in a region, other than the first zone and the space that has already been cleaned by the first robotic cleaner 1601, in the entire space to be cleaned, as an available cleaning zone thereof. For example, the information about the space that has already been cleaned by the first robotic cleaner 1607 may be transmitted together with or separately from the information about the first zone when transmitting the information about the first zone.

In operation 1650, the second robotic cleaner 1607 may transmit information about the second zone to the electronic device 1605.

According to an embodiment, the second robotic cleaner 1607 may be communicatively connected to the electronic device 1605 through a communication interface, and may transmit information about the second zone to the electronic device 1605.

In operation 1660, the second robotic cleaner 1607 may transmit the information about the first zone and the information about the second zone to a third robotic cleaner 1608.

According to an embodiment, the second robotic cleaner 1607 may be communicatively connected to the third robotic cleaner 1608 through a communication interface, and may transmit the information about the first zone and the information about the second zone to the third robotic cleaner 1608.

In operation 1670, the third robotic cleaner 1608 may determine the third zone as an available cleaning zone thereof based on the information about the first zone and the information about the second zone.

According to an embodiment, the third robotic cleaner 1608 may determine the third zone in a region, other than the first zone and the second zone, as an available cleaning zone thereof.

According to an embodiment, the third robotic cleaner 1608 may operate like the robotic cleaner of the embodiment of FIG. 2 so as to determine the third zone in a region, other than the first zone and the second zone, as an available cleaning zone thereof. For example, the third robotic cleaner 1608 may execute an operation of identifying the residual capacity of the battery and an operation of determining the third zone in the region, other than the first zone and the third zone, as an available cleaning zone thereof based on the identified residual capacity of the battery.

According to another embodiment, the third robotic cleaner 1608 may determine the third zone in a region, other than the space that has already been cleaned by the first robotic cleaner 1601, the first zone, and the second zone, in the entire space to be cleaned, as an available cleaning zone thereof. For example, the information about the space that has already been cleaned by the first robotic cleaner 1601 may be transmitted together with or separately from the information about the first zone and the second zone when transmitting the information about the first zone and the second zone.

In operation 1680, the third robotic cleaner 1608 may transmit information about the third zone to the electronic device 1605.

According to an embodiment, the third robotic cleaner 1608 may be communicatively connected to the electronic device 1605 through a communication interface, and may transmit the information about the third zone to the electronic device 1605.

In operation 1690, the electronic device 1605 may execute the operation of providing the information about the first zone of the first robotic cleaner 1601, the information about the second zone of the second robotic cleaner 1607, and the information about the third zone of the third robotic cleaner 1608.

According to an embodiment, the electronic device 1605 may display the information about the first zone of the first robotic cleaner 1601, the information about the second zone of the second robotic cleaner 1607, and the information about the third zone of the third robotic cleaner 1608 on a display.

In the embodiment described above with reference to FIG. 16, it has been described that the first robotic cleaner 1601 transmits the information about the first zone to the electronic device 1605, the second robotic cleaner 1607 transmits the information about the second zone to the electronic device 1605, and the third robotic cleaner 1608 transmits the information about the third zone to the electronic device 1605. However, according to another embodiment, the third robotic cleaner 1608 may transmit the information about the first zone, the information about the second zone, the information about the third zone to the electronic device 1605.

Figure 17:
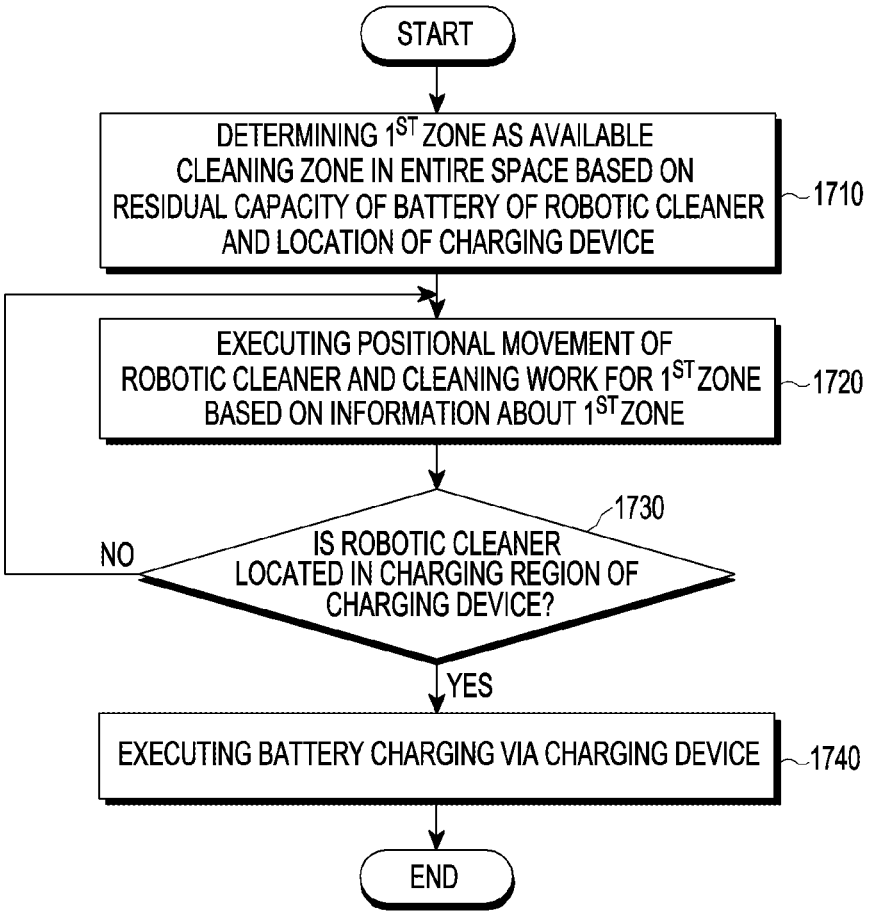
FIG. 17 is a flow chart of a control operation of a robotic cleaner according to various embodiments.

FIG. 17 is a flowchart of a control operation of a robotic cleaner (e.g., the robotic cleaner 101, the processor 110 of the robotic cleaner, the robotic cleaner 107, or the processor (not illustrated) of the robotic cleaner 107) according to various embodiments of the disclosure.

In operation 1710, a robotic cleaner may determine a first zone in the entire space as an available cleaning area based on the residual capacity of the battery (e.g., the battery 122) thereof and the location of the charging device (e.g., charging device 103).

According to an embodiment, a robotic cleaner may determine the first zone in the entire space as the available cleaning zone based on the residual capacity of the battery and the location of the charging device when the residual capacity of the battery is a predetermined threshold or less during the execution of the cleaning work for the entire space. For example, the first zone may be a zone other than the zone in which cleaning work for the entire space has been performed before determining the first zone.

In operation 1720, the robotic cleaner may execute a positional movement thereof and cleaning work for the first zone based on the information about the first zone.

According to an embodiment, the robotic cleaner may execute the cleaning work for the first zone using a predetermined or determined travel pattern (or a predetermined algorithm).

For example, the execution of the cleaning work for the first zone may include a positional movement operation and/or a cleaning work operation of the first zone of the robotic cleaner based on the information about the first zone.

For example, the robotic cleaner may finally perform a positional movement into the charging region of the charging device while executing the cleaning work for the first zone. As another example, the robotic cleaner may perform the positional movement into the charging region of the charging device after completing the cleaning work for the first zone.

In operation 1730, the robotic cleaner may determine whether the robotic cleaner is located in the charging region of the charging device.

According to an embodiment, when the robotic cleaner moves into the charging region of the charging device, the charging device may detect that the robotic cleaner is located in the charging region.

When it is determined by the charging device that the robotic cleaner is located in the charging region, operation 1740 is executed. Otherwise, the robotic cleaner may continuously execute operation 1720.

In operation 1740, the robotic cleaner may execute battery charging via the charging device.

According to an embodiment, when the charging device detects that the robotic cleaner is located in the charging region, the battery-charging operation of the robotic cleaner may be performed.

According to various embodiments, a method of controlling a robotic cleaner (e.g., the robotic cleaner 101) may include: an operation of determining a first zone in an entire space as an available cleaning zone in consideration of a residual capacity of a battery (e.g., the battery 12) of the robotic cleaner and a location of a charging device; and an operation of performing movement to the charging device while executing cleaning work for the first zone.

According to various embodiments, the method may further include: an operation of determining whether the residual capacity of the battery is a predetermined threshold or less during the execution of the cleaning work for the entire space. The operation of determining the first zone in the entire space as an available cleaning zone is performed when the residual capacity of the battery is the predetermined threshold or less during the execution of the cleaning work for the entire space.

According to various embodiments, the method may further include an operation of displaying information about the first zone on a display (e.g., the display 116) of the robotic cleaner.

According to various embodiments, the method may further include an operation of transmitting the information about the first zone to an external electronic device.

According to various embodiments, the method may further include an operation of performing a positional movement to the charging device while executing cleaning work for the second zone when receiving a cleaning work command for the second zone in the entire space.

According to various embodiments, the method may further include an operation of determining whether the positional movement to the charging device is possible after the cleaning of the second zone is completed in consideration of the residual capacity of the battery and the location of the charging device when receiving the cleaning work command for the second zone and executing at least one of displaying information corresponding to the determining on the display of the robotic cleaner and transmitting the information corresponding to the determination to an external electronic device.

According to various embodiments, the method may further include an operation of receiving information about the second zone from an external first robotic cleaner. The operation of determining the first zone in the entire space as an available cleaning zone may include an operation of determining the first zone, which does not overlap the second zone, in the entire space, as an available cleaning zone, in consideration of the residual capacity of the battery, the location of the charging device, and the information about the second zone.

According to various embodiments, a machine-readable storage medium, which stores a program for executing a method of controlling a robotic cleaner (e.g., the robotic cleaner 101), wherein the method may include: an operation of determining a first zone in an entire space as an available cleaning zone in consideration of a residual capacity of a battery of the robotic cleaner and a location of a charging device; and an operation of performing a positional movement to the charging device while executing cleaning work for the first zone.

The electronic device according to various embodiments may be one of various types of electronic devices. The electronic devices may include, for example, a portable communication device (e.g., a smart phone), a computer device, a portable multimedia device, a portable medical device, a camera, a wearable device, or a home appliance. According to an embodiment of the disclosure, the electronic devices are not limited to those described above.

It should be appreciated that various embodiments of the disclosure and the terms used therein are not intended to limit the technological features set forth herein to particular embodiments and include various changes, equivalents, or alternatives for a corresponding embodiment. With regard to the description of the drawings, similar reference numerals may be used to designate similar or relevant elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases. As used herein, such terms as "a first", "a second", "the first", and "the second" may be used to simply distinguish a corresponding element from another, and does not limit the elements in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via another element (e.g., third element).

As used herein, the term "module" may include a unit implemented in hardware, software, or firmware, and may be interchangeably used with other terms, for example, "logic," "logic block," "component," or "circuit". The "module" may be a minimum unit of a single integrated component adapted to perform one or more functions, or a part thereof. The "module" may be mechanically or electronically implemented. For example, according to an embodiment, the "module" may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Herein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., Play Store™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each element (e.g., a module or a program) of the above-described elements may include a single entity or multiple entities. According to various embodiments, one or more of the above-described elements may be omitted, or one or more other elements may be added. Alternatively or additionally, a plurality of elements (e.g., modules or programs) may be integrated into a single element. In such a case, according to various embodiments, the integrated element may still perform one or more functions of each of the plurality of elements in the same or similar manner as they are performed by a corresponding one of the plurality of elements before the integration. According to various embodiments, operations performed by the module, the program, or another element may be carried out sequentially, in parallel, repeatedly, or heuristically, or one or more of the operations may be executed in a different order or omitted, or one or more other operations may be added.

What is claimed is:

1. A robotic cleaner comprising:

a communication interface:

a battery;

a motor;

at least one wheel;

a cleaning device configured to perform cleaning work; and a processor configured to:

perform a cleaning work for an entire space, based on identifying that a residual capacity of the battery is a predetermined threshold or less during the cleaning work, determine a first zone in the entire space as an available cleaning zone other than a cleaning zone that has already been cleaned based on the residual capacity of the battery and a location of a charging device, transmit, through the communication interface, information about the first zone to an external first robotic cleaner such that the external first robotic cleaner determines a second zone different from the first zone as an available cleaning zone, control the motor to rotate the at least one wheel to move the robotic cleaner to the charging device while controlling the cleaning device to perform the cleaning work for the first zone, wherein the first zone does not overlap the second zone.

2. The robotic cleaner of claim 1, wherein the robotic cleaner is configured to receive charging power from the charging device when the robotic cleaner is located within a charging region of the charging device.

3. The robotic cleaner of claim 1, further comprising a display, wherein the processor is configured to control to display information about the first zone on the display.

4. The robotic cleaner of claim 1, wherein the processor is configured to control to transmit information about the first zone and the second zone to an external electronic device through the communication interface.

5. The robotic cleaner of claim 1, further comprising a display, wherein the processor is configured to:

determine a completion time of the cleaning work for the first zone based at least in part on at least one of the residual capacity of the battery or information about the first zone, and control to perform at least one of an operation of displaying the determined completion time on the display or an operation of transmitting the determined completion time to an external electronic device through the communication interface.

6. The robotic cleaner of claim 1, further comprising:

an input interface; and wherein the processor is configured to:

control the motor to rotate the at least one wheel to move the robotic cleaner to the charging device while controlling the cleaning device to perform the cleaning work for a third zone when receiving a cleaning work command for the third zone through the input interface or the communication interface.

7. The robotic cleaner of claim 6, further comprising a display, wherein the processor is configured to:

determine whether a movement of the robotic cleaner to the charging device is possible after a completion of the cleaning work for the third zone based on the residual capacity of the battery and the location of the charging device when receiving the cleaning work command for the third zone, and control to display information corresponding to the determination whether the movement of the robotic cleaner to the charging device is possible on the display.

8. The robotic cleaner of claim 6, wherein the processor is configured to:

determine whether a movement of the robotic cleaner to the charging device is possible after a completion of the cleaning work for the third zone based on the residual capacity of the battery and the location of the charging device when receiving the cleaning work command for the third zone, and control to transmit information corresponding to the determination whether the movement of the robotic cleaner to the charging device is possible to an external electronic device through the communication interface.

9. The robotic cleaner of claim 1, wherein the processor is configured to control to transmit the information about the first zone and the information about the second zone to an external second robotic cleaner through the communication interface.

10. A method of controlling a robotic cleaner, the method comprising:

performing a cleaning work for an entire space;

based on identifying that a residual capacity of a battery of the robotic cleaner is a predetermined threshold or less during the cleaning work, determining a first zone in the entire space as an available cleaning zone other than a cleaning zone that has already been cleaned based on the residual capacity of the battery and a location of a charging device;

transmitting, through a communication interface of the robotic cleaner, information about the first zone to an external first robotic cleaner such that the external first robotic cleaner determines a second zone different from the first zone as an available cleaning zone; and controlling a motor of the robotic cleaner to rotate at least one wheel of the robotic cleaner to move the robotic cleaner to the charging device while controlling a cleaning device of the robotic cleaner to perform cleaning work for the first zone, wherein the first zone does not overlap the second zone.

11. A non-transitory machine-readable storage medium, which stores a program for controlling a robotic cleaner, the program, when executed, causing the robotic cleaner to perform operations comprising:

performing a cleaning work for an entire space:

based on identifying that a residual capacity of a battery of the robotic cleaner is a predetermined threshold or less during the cleaning work, determining a first zone in the entire space as an available cleaning zone other than a cleaning zone that has already been cleaned based on the residual capacity of the battery and a location of a charging device;

transmitting, through a communication interface of the robotic cleaner, information about the first zone to an external first robotic cleaner such that the external first robotic cleaner determines a second zone different from the first zone as an available cleaning zone; and controlling a motor of the robotic cleaner to rotate at least one wheel of the robotic cleaner to move the robotic cleaner to the charging device while controlling a cleaning device of the robotic cleaner to perform cleaning work for the first zone, and wherein the first zone does not overlap the second zone.

* * * * *